US007424430B2

(12) United States Patent
Kawahara et al.

(10) Patent No.: US 7,424,430 B2
(45) Date of Patent: Sep. 9, 2008

(54) TONE GENERATOR OF WAVE TABLE TYPE WITH VOICE SYNTHESIS CAPABILITY

(75) Inventors: Takehiko Kawahara, Hamamatsu (JP); Nobukazu Nakamura, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 869 days.

(21) Appl. No.: 10/765,379

(22) Filed: Jan. 26, 2004

(65) Prior Publication Data

US 2004/0158470 A1 Aug. 12, 2004

(30) Foreign Application Priority Data

Jan. 30, 2003 (JP) ..... 2003-021680
Jan. 30, 2003 (JP) ..... 2003-021681
Jan. 30, 2003 (JP) ..... 2003-021682
Jan. 30, 2003 (JP) ..... 2003-021683

(51) Int. Cl.
*G10L 13/00* (2006.01)

(52) U.S. Cl. ..... 704/268

(58) Field of Classification Search ..... 704/207, 704/219, 258, 260, 265–268, 270; 84/609, 84/622, 623, 626, 645
See application file for complete search history.

(56) References Cited

U.S. PATENT DOCUMENTS 4,833,963 A 5/1989 Hayden
5,321,794 A 6/1994 Tamura
5,703,311 A 12/1997 Ohta
5,744,741 A 4/1998 Nakajima
6,407,326 B1 * 6/2002 Kondo ..... 84/615
6,570,078 B2 * 5/2003 Ludwig ..... 84/600
6,610,917 B2 * 8/2003 Ludwig ..... 84/726
6,689,947 B2 * 2/2004 Ludwig ..... 84/721
6,825,919 B2 * 11/2004 Beimers et al. ..... 356/72
6,849,795 B2 * 2/2005 Ludwig ..... 84/661
6,865,533 B2 * 3/2005 Addison et al. ..... 704/260
6,993,480 B1 * 1/2006 Klayman ..... 704/226
7,038,123 B2 * 5/2006 Ludwig ..... 84/723

FOREIGN PATENT DOCUMENTS

JP 56-51795 5/1981
JP HEI-4-251297 9/1992
JP HEI-4-346502 12/1992
JP 8-194484 7/1996

* cited by examiner

*Primary Examiner*—Michael N Opsasnick
(74) *Attorney, Agent, or Firm*—Morrison & Foerster LLP

(57) ABSTRACT

A sound source apparatus has a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode. Each tone forming part has an envelope application section that operates in the wave table sound source mode for generating an envelope signal which rises in synchronization with an instruction to start the generating of the tone and decays in synchronization with another instruction to stop the generating of the tone, and applying the generated envelope signal to waveform data read from a wave table. The envelope application section operates in the voice synthesizing mode for generating an envelope signal which rapidly decays every timing corresponding to a pitch period of the voice to be synthesized and rapidly rises after the decay, and applying the generated envelope signal to the waveform data read from a wave table.

26 Claims, 10 Drawing Sheets

CASE OF VOICED SOUND PITCH SIGNAL

CASE OF UNVOICED SOUND FORMANT

FIG.14

| | | | | | | | |
|---|---|---|---|---|---|---|---|
| 0 | | 1 | | 2 | | 3 | |
| 4 | | 5 | | 6 | | 7 | |
| 8 | | 9 | | 10 | | 11 | |
| 12 | | 13 | | 14 | | 15 | USE ANY WAVEFORM ON MEMORY |
| 16 | | 17 | | 18 | | 19 | |
| 20 | | 21 | | 22 | | 23 | USE ANY WAVEFORM ON MEMORY |
| 24 | | 25 | | 26 | | 27 | |
| 28 | | 29 | | 30 | | 31 | USE ANY WAVEFORM ON MEMORY |

TONE GENERATOR OF WAVE TABLE TYPE WITH VOICE SYNTHESIS CAPABILITY

BACKGROUND OF THE INVENTION

1. Technical Field of the Invention

The present invention relates to a sound source apparatus with voice synthesis capabilities, which can not only produce musical tones but also synthesize a voice. The present invention also relates to a voice synthesizing apparatus capable of synthesizing multiple vocal formants to generate a synthesized voice.

2. Prior Art

To implement voice synthesis capabilities in a conventional sound source apparatus, since the conventional sound source apparatus has no function of producing voice, a separate voice synthesizing apparatus needs to be incorporated into the sound source apparatus. As an example, a prior art voice synthesizing apparatus operates on the principle that the voice of a short duration from a few milliseconds to a few tens of milliseconds is considered to be in a steady state to represent the voice as the sum of a few sine waves. There is known a voice synthesizing apparatus that resets every pitch cycle the phase of a sine-wave generator for generating sine waves to form a voiced sound, or initializes the phase of the sine-wave generator on a random basis to broaden the spectrum of the voice so as to form an unvoiced sound (for example, see Patent Document 1).

Patent Document 1 is Japanese Examined Patent Publication No. 58-53351 (Laid-open No. 56-051795).

However, the incorporation of the voice synthesizing apparatus into the sound source apparatus increases not only the size of the hardware of the voice synthesizing apparatus, but also the price of the voice synthesizing apparatus. Further, the conventional voice synthesizing apparatus can only synthesize an unreal voice of low quality.

SUMMARY OF THE INVENTION

It is therefore an object of the present invention to provide a sound source apparatus with voice synthesis capabilities which can synthesize a high-quality voice without the need to incorporate a separate voice synthesizing apparatus.

It is also an object of the present invention to provide a voice synthesizing apparatus capable of synthesizing a high-quality voice.

In order to attain the above object, according to a first aspect of the invention, a sound source apparatus having a voice synthesis capability comprises a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode. Each of the tone forming parts comprises a waveform shape specifying section that specifies a desired waveform shape from among a plurality of waveform shapes, a waveform data storage section that stores waveform data corresponding to the plurality of the waveform shapes, a waveform data reading section that operates in the wave table sound source mode for generating a variable address changing at a rate corresponding to a musical interval of the tone to be generated, and reading the waveform data corresponding to the waveform shape specified by the waveform shape specifying section from the waveform data storage section by the variable address, and that operates in the voice synthesizing mode for generating a variable address changing at a rate corresponding to a center frequency of the formant to be generated, and reading the waveform data corresponding to the waveform shape specified by the waveform shape specifying section from the waveform data storage section by the variable address, and an envelope application section that operates in the wave table sound source mode for generating an envelope signal which rises in synchronization with an instruction to start the generating of the tone and decays in synchronization with another instruction to stop the generating of the tone, and applying the generated envelope signal to the waveform data read by the waveform data reading section from the waveform data storage section, and that operates in the voice synthesizing mode for generating an envelope signal which rapidly decays every timing corresponding to a pitch period of the voice to be synthesized and rapidly rises after the decay, and applying the generated envelope signal to the waveform data read by the waveform data reading section from the waveform data storage section.

Further in the first aspect of the invention, a sound source apparatus having a voice synthesis capability comprises a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode. Each of the tone forming parts comprises a waveform shape specifying section that specifies a desired waveform shape from among a plurality of waveform shapes, a waveform data storage section that stores waveform data corresponding to the plurality of the waveform shapes, a waveform data reading section that operates in the wave table sound source mode for generating a variable address changing at a rate corresponding to a musical interval of the tone to be generated, and reading the waveform data corresponding to the waveform shape specified by the waveform shape specifying section from the waveform data storage section by the variable address, and that operates in the voice synthesizing mode for generating a variable address changing at a rate corresponding to a center frequency of the formant to be generated, and reading the waveform data corresponding to the waveform shape specified by the waveform shape specifying section from the waveform data storage section by the variable address, an envelope application section that generates an envelope signal which rises in synchronization with an instruction to start the generating of the tone or the synthesis of the voice and decays in synchronization with another instruction to stop the generating of the tone or the synthesis of the voice, and that applies the generated envelope signal to the waveform data read by the waveform data reading section from the waveform data storage section, and a noise adding section that operates in the voice synthesizing mode for adding a noise to the waveform data with the envelope signal applied by the envelope application section.

According to the first aspect of the present invention, the multiple tone forming parts can produce tones in the wave table sound source mode, while multiple formants formed by the multiple tone forming parts can be synthesized in the voice synthesizing mode to generate a synthesized voice. Thus, since the multiple tone forming parts can be commonly used for musical tone production and voce synthesis, the voice synthesis capabilities can be implemented in the sound source apparatus without the incorporation of a separate voice synthesizing apparatus into the sound source apparatus. Further, in the voice synthesis mode, the noise adding section adds noise to the formants, thereby synthesizing a high-quality, real voice.

In a second aspect of the invention, a voice synthesizing apparatus comprises a plurality of formant forming parts, each of which forms a formant having a desired formant center frequency and a desired formant level, and a synthesizing part that mixes a plurality of the formants formed by the plurality of the formant forming parts for generating a voice. Each of the plurality of the formant forming parts comprises a waveform data storage section that stores waveform data corresponding to a predetermined waveform shape, a waveform data reading section that generates an address changing at a rate corresponding to the formant center frequency so as to read the waveform data stored in the waveform data storage section by the generated address to thereby form the formant, and a noise adding section that adds a noise to the waveform data read by the waveform data reading section from the waveform data storage section.

Preferably, the formant forming part further comprises an envelope application section that generates an envelope signal which rises in synchronization with an instruction to start the generating of the voice and decays in synchronization with another instruction to stop the generating of the voice, and that applies the envelope signal to either of the waveform data read by the waveform data reading section from the waveform data storage section or the waveform data with the noise added by the noise adding section.

Preferably, the formant forming part further comprises a multiplication section that multiplies the waveform data by level data corresponding to the formant level.

Preferably, the synthesizing part mixes the plurality of the formants, each of which has the desired formant center frequency and the desired formant level and is outputted from each of the plurality of the formant forming parts so as to generate the voice of an unvoiced sound.

Preferably, the waveform data storage section stores sine waveform data.

Preferably, the noise adding section comprises a noise generator for generating a white noise and a filter for limiting a spectrum band of the white noise.

According to the second aspect of the present invention, the noise adding section is provided in each of the plurality of the formant forming parts, each of which forms a formant having a desired formant center frequency and a desired formant level, so that the plurality of formants formed in the plurality of the formant forming parts are synthesized to generate a synthesized voice. Thus, in the voice synthesizing apparatus, since the noise adding section adds noise to the plurality of formants, a high-quality, real voice can be synthesized.

In a third aspect of the invention, a voice synthesizing apparatus comprises a plurality of formant forming parts for forming formants having desired formant center frequencies in the form of either voiced sound formants or unvoiced sound formants according to designation of a voiced sound synthesizing mode or an unvoiced sound synthesizing mode, and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound. Each of the plurality of the formant forming parts comprises a waveform data storage section that stores waveform data corresponding to a predetermined waveform shape, a waveform data reading section that generates an address changing at a rate corresponding to the formant center frequency of the formant and reads the waveform data stored in the waveform data storage section in response to the generated address, and an envelope application section that operates in the voiced sound synthesizing mode for generating an envelop signal which rapidly decays every timing corresponding to a pitch period of the voiced sound and rapidly rises after the decay, and applying the generated envelope signal to the waveform data read by the waveform data reading section from the waveform data storage section, and that operates in the unvoiced sound synthesizing mode for generating an envelope signal which rises in synchronization with an instruction to start the generating of the unvoiced sound and decays in synchronization with an instruction to stop the generating of the unvoiced sound, and applying the generated envelope signal to the waveform data read by the waveform data reading section from the waveform data storage section.

Preferably, each of the formant forming parts further comprises a noise adding section that operates in the unvoiced sound synthesizing mode for adding a noise to the waveform data read by the waveform data reading section from the waveform data storage section.

Further in the third aspect of the invention, a voice synthesizing apparatus comprises a plurality of formant forming parts for forming formants having formant center frequencies in the form of either voiced sound formants or unvoiced sound formants according to designation of either a voiced sound synthesizing mode or an unvoiced sound synthesizing mode, and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound. Each of the plurality of the formant forming parts comprises a waveform data storage section that stores waveform data corresponding to a plurality of waveform shapes, a waveform shape specifying section that operates in the voiced sound synthesizing mode for specifying a desired waveform shape from among the plurality of the waveform shapes, and that operates in the unvoiced sound synthesizing mode for specifying a predetermined waveform shape, a waveform data reading section that generates an address changing at a rate corresponding to the formant center frequency and reads from the waveform data storage section the waveform data corresponding to the waveform shape specified by the waveform shape specifying section in response to the generated address, and an envelope application section that operates in the voiced sound synthesizing mode for generating an envelop signal which rapidly decays every timing corresponding to a pitch period of the voiced sound and rapidly rises after the decay, and applying the generated envelope signal to the waveform data read by the waveform data reading section from the waveform data storage section, and that operates in the unvoiced sound synthesizing mode for generating an envelope signal which rises in synchronization with an instruction to start the generating of the unvoiced sound and decays in synchronization with an instruction to stop the generating of the unvoiced sound, and applying the generated envelope signal to the waveform data read by the waveform data reading section from the waveform data storage section.

Preferably, each of the formant forming parts further comprises a noise adding section that operates in the unvoiced sound synthesizing mode for adding a noise to the waveform data read by the waveform data reading section from the waveform data storage section.

According to the third aspect of the present invention, the multiple formant forming parts form desired voiced or unvoiced sound formants so that the multiple voiced or unvoiced sound formants formed will be mixed to synthesize a voiced or unvoiced sound. Then the envelope signal of the pitch cycle is added to the waveform data for forming voiced sound formants. As a result, the voiced sound formants can be given a sense of pitch, thereby synthesizing a high-quality, real voice. Further, noise is added to the waveform data for forming unvoiced sound formants, thereby synthesizing a high-quality, real voice.

In a fourth aspect of the invention, a voice synthesizing apparatus comprises a plurality of formant forming parts, each of which forms a formant having a desired formant center frequency, and a synthesizing part that mixes a plurality of the formants formed by the plurality of the formant forming parts to generate a voice. Each of the plurality of the formant forming parts comprises a waveform shape specifying section that specifies a desired waveform shape from among a plurality of waveform shapes, a waveform data storage section that stores waveform data corresponding to the plurality of the waveform shapes, a waveform data reading section that generates an address changing at a rate corresponding to the formant center frequency and reads from the waveform data storage section the waveform data corresponding to the specified waveform shape in response to the generated address, and an envelope application section that generates an envelope signal which rapidly decays every timing corresponding to a pitch period of the voice and rapidly rises after the decay, and that applies the generated envelope signal to the waveform data read by the waveform data reading section from the waveform data storage section.

Preferably, the synthesizing part mixes the plurality of the formants formed by the plurality of the formant forming parts to generate the voice in the form of a voiced sound.

According to the fourth aspect of the present invention, each of the multiple formant forming parts forms a formant having a desired formant center frequency and a desired formant level so that the multiple formants formed will be synthesized to generate a synthesized voice. Then, the envelope signal of the pitch cycle is added to the waveform data for forming the formants, so that the formants can be given a sense of pitch, thereby synthesizing a high-quality, real voice. Further, since the envelope signal of the pitch cycle is added to the waveform data for forming voiced sound formants, the voiced sound formants can be given a sense of pitch.

BRIEF DESCRIPTION OF THE DRAWINGS

FIG. 14 is a diagram showing examples of a plurality of waveform shapes of waveform data for forming voiced sound formants or unvoiced sound formants stored in a waveform data storage in the voice synthesizing apparatus that also serves as the sound source apparatus according to the embodiment of the present invention.

DETAILED DESCRIPTION OF THE INVENTION

Figure 1:
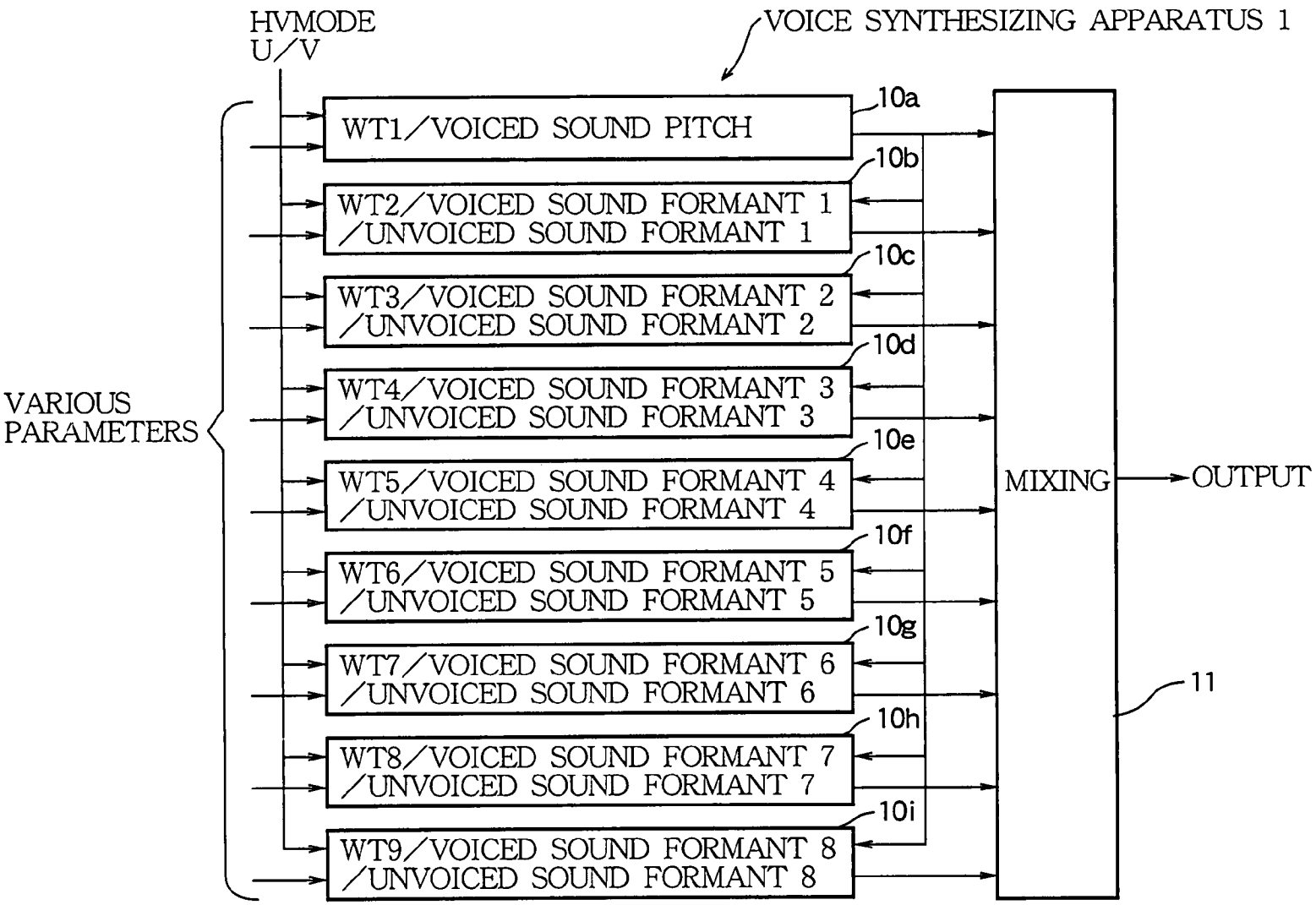
FIG. 1 is a block diagram showing the structure of a voice synthesizing apparatus that also serves as a sound source apparatus according to an embodiment of the present invention.

FIG. 1 is a block diagram showing the structure of a voice synthesizing apparatus that also serves as a sound source apparatus according to an embodiment of the present invention.

A voice synthesizing apparatus 1 shown in FIG. 1 is made up of a waveform data storage storing waveform data on a plurality of waveform shapes, nine waveform table voice (WT voice) parts 10*a*, 10*b*, 10*c*, 10*d*, 10*e*, 10*f*, 10*g*, 10*h*, and 10*i*, each of which has at least one reading section that reading predetermined waveform data from the waveform data storage, and mixing section 11 for mixing the waveform data outputted from the WT voice parts 10*a* to 10*i*. The mixing section 11 outputs a generated musical sound or synthesized voice. In this case, the WT voice parts 10*a* to 10*i* are supplied with tone parameters and voice parameters as various parameters, and when a voice mode flag (HVMODE) to indicate tone/voice production indicates the production of musical sound (HVMODE=0), the tone parameters are selected and used in the WT voice parts 10*a* to 10*i*. Then the WT voice parts 10*a* to 10*i* produce waveform data on multiple musical tones based on the selected tone parameters and outputs the waveform data. Upon receipt of the waveform data, the mixing section 11 outputs the sound of nine tones at the maximum.

On the other hand, when the voice mode flag (HVMODE) to indicate tone/voice production indicates the production of vocal sound (HVMODE=1), the voice parameters are selected and used in the WT voice parts 10*a* to 10*i*. Then the WT voice parts 10*a* to 10*i* produce waveform data for forming a voiced sound pitch signal, voiced sound formants, or unvoiced sound formants based on the voice parameters, and output the waveform data. Upon receipt of the waveform data, the mixing section 11 synthesizes the waveform data for forming the voiced sound formants or unvoiced sound formants to output a voice. It should be noted that "HV" in "HVMODE" stands for Human Voice, and "U/V" is an indication flag to indicate Unvoiced Sound/Voice Sound. When HVMODE=1 and U/V=0 are supplied, the WT voice parts 10*b* to 10*i* output waveform data for forming voiced sound formants. The WT voice part 10*a* to which HVMODE=1 and U/V=0 are supplied outputs a voiced sound pitch signal to define the pitch period of the voiced sound without using any waveform data. The voiced sound pitch signal from the WT voice part 10*a* is supplied to the WT voice parts 10*b* to 10*i* so that the phase of the waveform data for forming voiced sound formants will be reset every cycle of the voiced sound pitch signal. In addition, the envelope shape of each voiced sound formant is made correspondent to the cycle of the voiced pitch signal. As a result, the voiced sound formants can be given a sense of pitch.

On the other hand, when HVMODE=1 and U/V=1 are supplied, the WT voice parts 10*b* to 10*i* output waveform data for forming unvoiced sound formants. In this case, the output of the WT voice part 10*a* to which HVMODE=1 and U/V=1 are supplied is not used. Thus, when HVMODE=1 is set, the WT voice parts 10*b* to 10*i* can output the maximum of eight voiced or unvoiced sound formants.

The following describes the general idea of voice. Although any voice is produced by vibration of the vocal cords, the frequency at which the vocal cords vibrate remains about the same even when different words are sounded out. Resonances produced by different sizes of mouth opening or different shapes of the throat cavity or vocal tract, and the addition of fricative or plosive phonemes to the vibration of the vocal cords produce a variety of vocal sounds. In such vocal sounds, multiple parts called formants where spectra are concentrated in specific frequency bands exist on a frequency axis. The center frequency of the formants or the frequency of the maximum amplitude is called the formant center frequency. The number of formants in a vocal sound, and the center frequency, amplitude, and bandwidth of each formant are factors to define the characteristics of the vocal sound, and largely depend on the gender, physical attribute, age, etc. of the speaker. On the other hand, the combination of characteristic formants is fixed for each kind of word, and has no relation with the voice type. Formant types are broadly categorized into voiced formants having a sense of pitch and used for synthesizing a voiced sound, and unvoiced formants having no sense of pitch and used for synthesizing an unvoiced sound. The voiced sound is a sound produced when the vocal cords vibrate, including vowels, semivowels, and voiced consonants such as b, g, m, r, etc. The unvoiced sound is a sound produced without vibration of the vocal cords, corresponding to unvoiced consonants such as h, k, s, etc.

According to the present invention, when a musical tone is generated in the voice synthesizing apparatus having the structure shown in FIG. 1 and serving also as a sound source apparatus, HVMODE=0 is set and the WT voice parts 10*a* to 10*i* generate a plurality of tones, that is, they can produce the sound of nine tones at the maximum.

Upon synthesizing a voice, the WT voice parts 10*b* to 10*i* form voiced sound formants or unvoiced sound formants corresponding to a voiced sound or unvoiced sound to be synthesized in the mode of HVMODE=1. In this case, the voice to be synthesized is a combination of the maximum of eight formants. For example, when the voice to be synthesized is voiced, U/V=0 is supplied to the WT voice parts 10*b* to 10*i* so that the WT voice parts 10*b* to 10*i* will form voiced sound formants respectively based on the voice parameters supplied. At this time, U/V=0 is supplied to the WT voice part 10*a* so that the WT voice part 10*a* will generate a voiced sound pitch signal based on the voice parameters supplied. The voiced sound pitch signal is supplied to the WT voice parts 10*b* to 10*i* so that the phase of waveform data for forming each of voiced sound formants to be outputted will be reset every cycle of the voiced sound pitch signal. In addition, the envelope shape of each voiced sound formant is made correspondent to the cycle of the voiced pitch signal. As a result, the WT voice parts 10*b* to 10*i* form voiced sound formants having a sense of pitch.

On the other hand, when the voice to be synthesized is unvoiced, HVMODE=1 and U/V=1 are supplied to the WT voice parts 10*b* to 10*i* so that the WT voice parts 10*b* to 10*i* will form unvoiced sound formants respectively based on the voice parameters supplied. As will be described later, in the case of unvoiced sound synthesis, noise is added to the unvoiced sound formants, thereby synthesizing a high-quality, real vocal sound. It should be noted that the output of the WT voice part 10*a* is not used for the synthesis of unvoiced sound.

Figure 2:
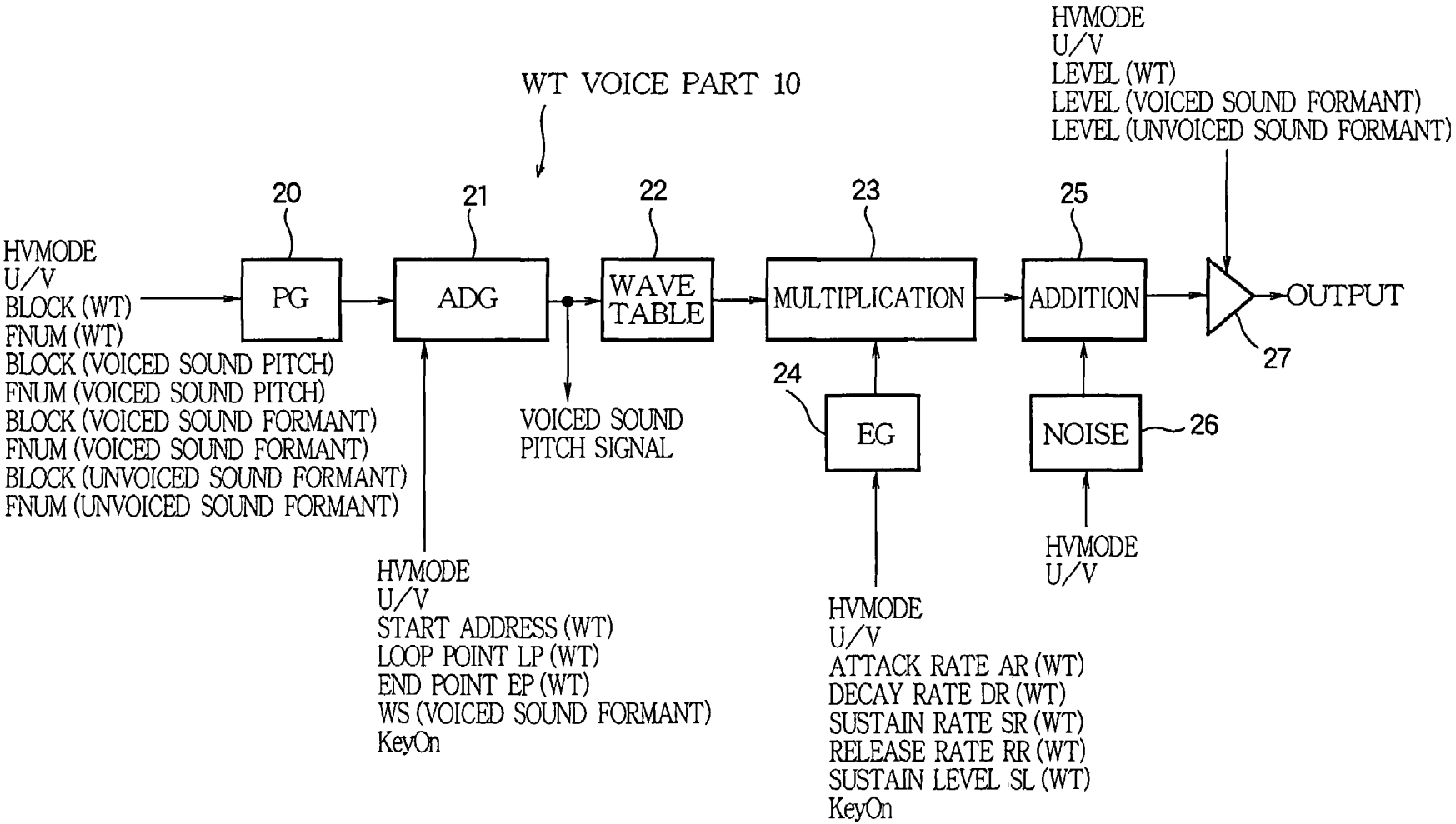
FIG. 2 is a schematic block diagram showing the structure of a WT voice part in the voice synthesizing apparatus that also serves as the sound source apparatus according to the embodiment of the present invention.

The WT voice parts 10*a* to 10*i* in the voice synthesizing apparatus 1 has the same structure. The following describes the structure as WT voice part 10. FIG. 2 is a schematic block diagram showing the structure of the WT voice part 10. In this and the following figures, the notations of "WT," "VOICED SOUND FORMANT," and "UNVOICED SOUND FORMANT" indicate that the parameters are for generating a musical tone, a voiced sound formant, and an unvoiced sound formant, respectively.

In FIG. 2, a phase data generator (PG: Phase Generator) 20 generates phase data corresponding any one of the pitch of a tone to be generated or voiced sound pitch signal, the center frequency of voiced sound formants, and the center frequency of unvoiced sound formants. The PG 20 is supplied with flag information on the voice mode flag (HVMODE) and the unvoiced/voiced sound indication flag (U/V), and tone octave information BLOCK (WT) and tone frequency information FNUM (WT) as tone parameters. The PG 20 is also supplied, as voice parameters, with octave information BLOCK (VOICED SOUND PITCH) on the voiced sound pitch signal and frequency information FNUM (VOICED SOUND PITCH) on the voiced sound pitch signal, or octave information BLOCK (VOICED SOUND FORMANT) on the voiced sound formants, frequency information FNUM (VOICED SOUND FORMANT) on the voiced sound formants, octave information BLOCK (UNVOICED SOUND FORMANT) on the unvoiced sound formants, and frequency information FNUM (UNVOICED SOUND FORMANT) on the unvoiced sound formants. In the PG 20, the various parameters supplied are selected according to the flag information, and the phase data corresponding to any one of the musical interval between tones to be generated or the voiced sound pitch signal, the center frequency of voiced sound formants, and the center frequency of unvoiced sound formants is generated.

Figure 3:
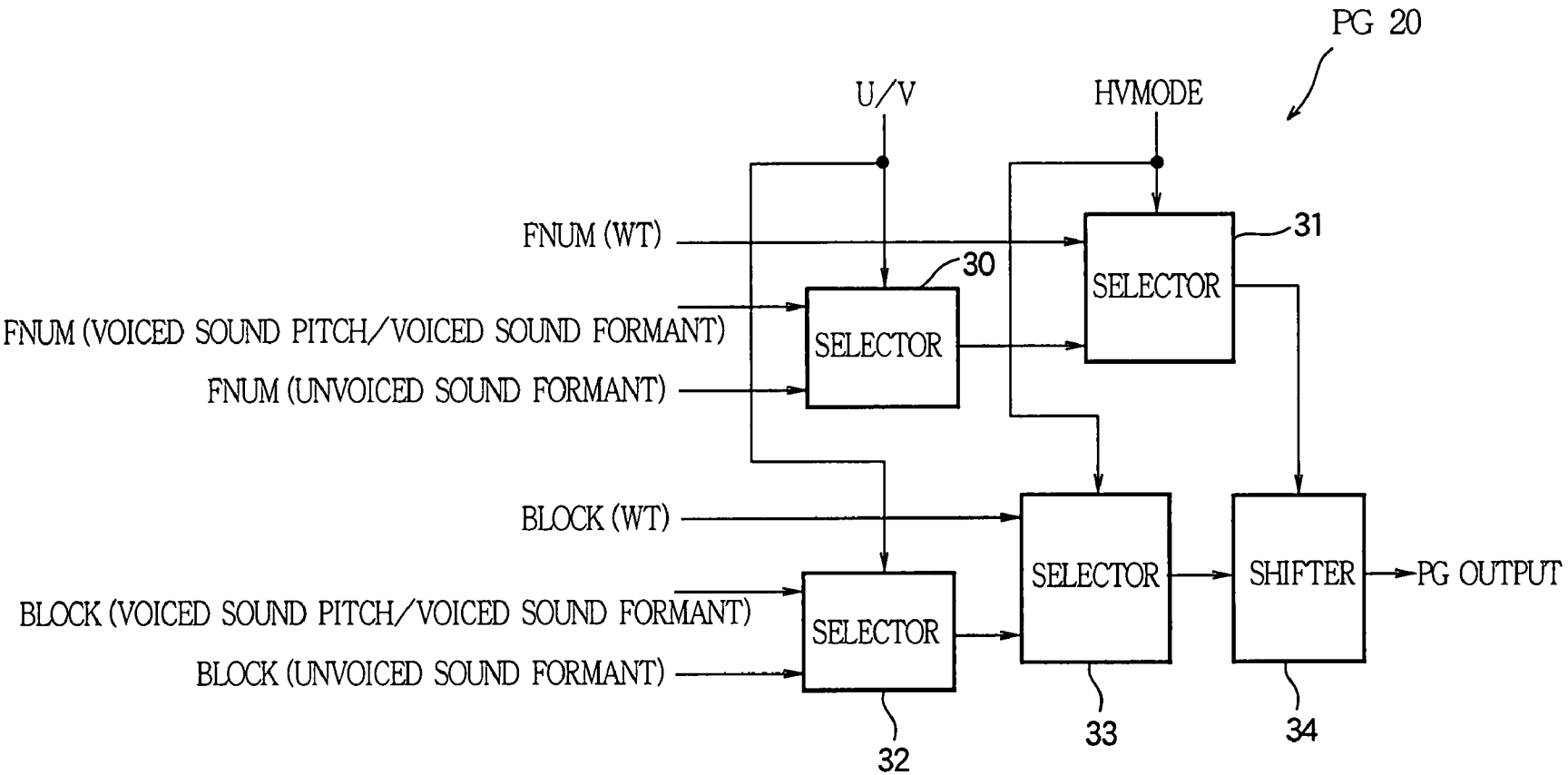
FIG. 3 is a block diagram showing the detailed structure of a phase data generator in the voice synthesizing apparatus that also serves as the sound source apparatus according to the embodiment of the present invention.

FIG. 3 shows the detailed structure of the PG 20. In FIG. 3, a selector 30 selects either the voiced sound pitch signal and the frequency information FNUM on voiced sound formants or the frequency information FNUM on unvoiced sound formants according to the state of the U/V flag, and outputs it to a selector 31. The selector 31 selects either the frequency information FNUM (WT) on musical tones or the voice-related frequency information FNUM outputted from the selector 30 according to the state of the HVMODE flag, and outputs it to a shifter 34 so that the frequency information FNUM outputted from the selector 31 will be set in the shifter 34. Further, a selector 32 selects either of the voiced sound pitch signal and the octave information BLOCK on voiced sound formants or the octave information BLOCK on unvoiced sound formants according to the state of the U/V flag, and outputs it to a selector 33. The selector 33 selects either the tone octave information BLOCK (WT) or the voice-related octave information BLOCK outputted from the selector 32 according to the state of the HVMODE flag, and outputs it to the shifter 34 as shift information so that the frequency information FNUM set in the shifter 34 will be shifted according to the octave information BLOCK. As a result, phase data with an octave effect added so that one of the musical interval between tones to be generated or the voiced sound pitch signal, the center frequency of voiced sound formants, and the center frequency of unvoiced sound formants will be generated is outputted from the PG 20 as PG output.

Returning to FIG. 2, the PG output from the PG 20 is inputted into an address generator (ADG) 21 in which the phase data as the PG output is accumulated to generate a read address for reading waveform data with a desired waveform shape from a waveform data storage (WAVE TABLE) 22. The ADG 21 is supplied with a start address SA (WT), a loop point LP (WT), and an end point EP (WT) as the tone parameters as well as flag information on the voice mode flag (HVMODE) and the unvoiced/voiced sound indication flag (U/V). The ADG 21 is also supplied as the voice parameters with a waveform select (WS) signal for selecting a waveform suitable for forming voiced sound formants, and a key-On signal to instruct the start of sound production commonly used for musical sound and vocal sound.

In the case of musical sound production, HVMODE=0 is set and the start address SA (WT) is outputted from the ADG 21 at the start timing of the Key-On signal to start the reading of waveform data from a position in the waveform data storage 22 as indicated by the start address SA (WT). Then the phase data from the PG 20 is accumulated so that the read address up to the end point EP (WT) will change at a rate corresponding to the musical interval between tones. The changed values of the read address are outputted one by one from the ADG 21. As a result, samples of waveform data up to a position in the waveform data storage 22 as indicated by the end point EP (WT) are read out one by one at the rate corresponding to the musical interval between tones. Next, another value of the read address corresponding to the loop point LP (WT) is outputted from the ADG 21, and the phase data from the PG 20 is further accumulated so that the read address up to the end point EP (WT) will change at the rate corresponding to the musical interval between tones. The changed values of the read address are outputted one by one from the ADG 21. As a result, samples of waveform data from a position in the waveform data storage 22 as indicated by the loop point LP (WT) to a position in the waveform data storage 22 as indicated by the end point EP (WT) are read out one by one at the rate corresponding to the musical interval between tones. The read address from the loop point LP (WT) to the end point EP (WT) is repeatedly generated until the sound production is stopped by the Key-On signal. As a result, desired waveform data can be read from the waveform data storage 22 at the rate corresponding to the musical interval between tones from the start of the sound production until the stop of the sound production as indicated by the Key-On signal.

In the case of voice synthesis, HVMODE=1 is set and the reading of waveform data is started from a position in the waveform data storage 22 as indicated by a start address specified by a WS (voiced sound formant) signal at the start timing of the Key-On signal or a predetermined start address for unvoiced sound formants. Then the phase data from the PG 20 is accumulated so that the read address within a fixed range will change at a rate corresponding to the center frequency of voiced sound formants or unvoiced sound formants. The changed values of the read address are outputted one by one from the ADG 21. As a result, samples of waveform data are read one by one from the waveform data storage 22 at the rate corresponding to the center frequency of the voiced sound formants or the unvoiced sound formants. In the WT voice part 10*a*, since it is set that the cumulative value of the phase data from the PG 20 will reach a predetermined value (constant value) every cycle of the voiced sound pitch, the voiced sound pitch signal (pulse signal) is outputted each time the cumulative value reaches the constant value.

Figure 4:
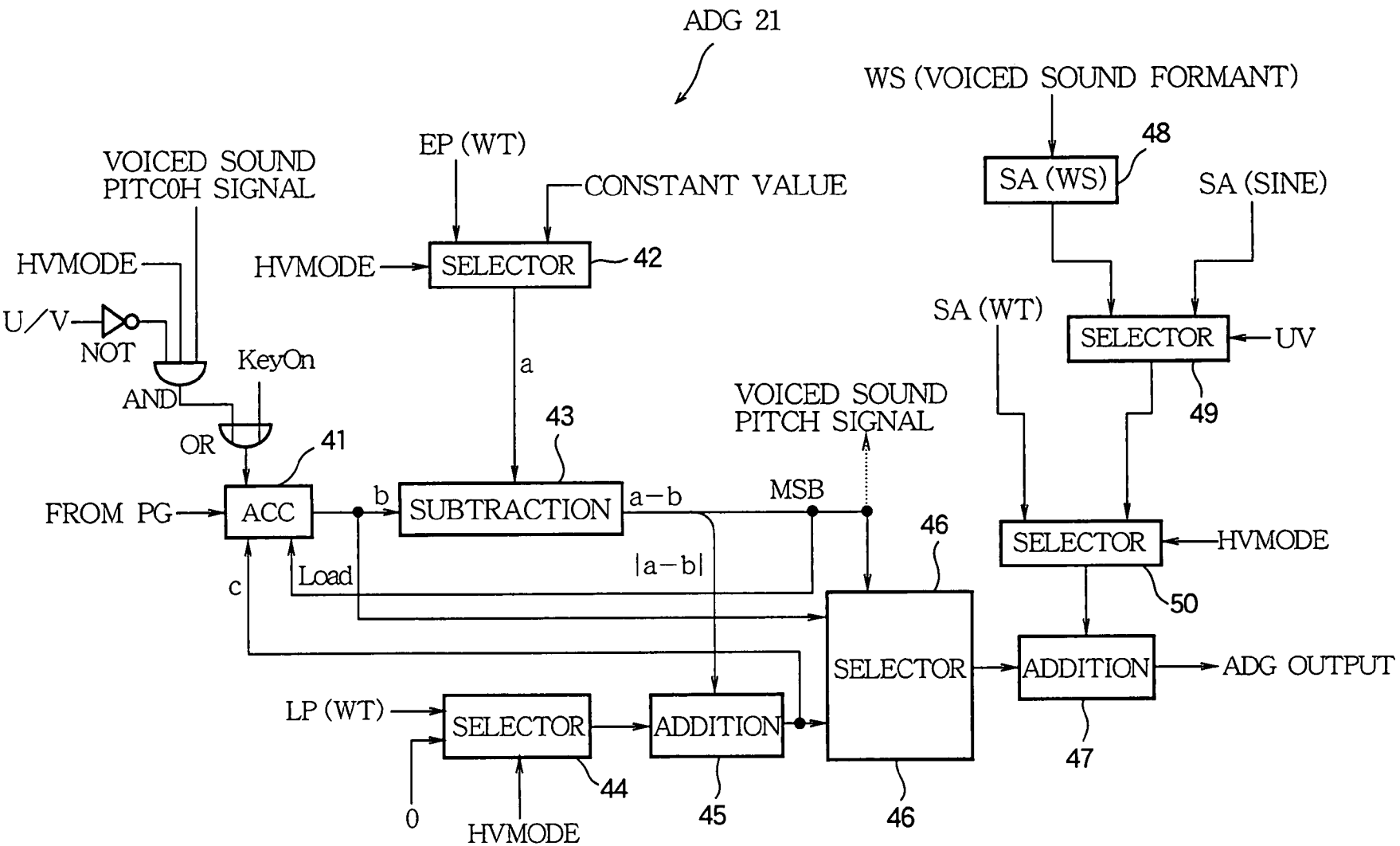
FIG. 4 is a block diagram showing the detailed structure of an address generator in the voice synthesizing apparatus that also serves as the sound source apparatus according to the embodiment of the present invention.

FIG. 4 shows the detailed structure of the ADG 21. In FIG. 4, the phase data from the PG 20 is inputted into an accumulator (ACC) 41 in which the phase data is accumulated every clock cycle so that the incremental value of a read address will be generated. The incremental value of the read addresses is supplied through a selector 46 to an adder 47 in which a start address is added to generate the read address. The read address is then outputted from the ADG 21 as ADG output.

The following describes the operation when HVMODE=0 is set in the ADG 21 for the production of musical sound. When HVMODE=0 is set, since an AND gate is closed, the ACC 41 is reset to the initial value by only the Key-On signal outputted from an OR gate to start the accumulation of the phase data from the PG 20 at a rate corresponding to the musical interval between tones to be produced. The accumulation is made every clock cycle, and a cumulative value b will be outputted to the selector 46 and a subtracter 43.

Since HVMODE=0 is set, a selector 42 for supplying data a to the subtracter 43 selects the end point EP (WT) as the data a and outputs it to the subtracter 43. As a result, a subtracted value (a−b) calculated at the subtracter 43 is outputted, and an amplitude value |a−b| obtained by removing MSB (Most Significant Bit) from the subtracted value (a−b) is supplied to an adder 45. When the subtracted value (a−b) is negative, the MSB signal as "1" is supplied to the selector 46 as a select signal and to the ACC 41 as a load signal. Since the MSB signal becomes "1" when the subtracted value (a−b) is negative, the selector 46 continues to output the cumulative value b to the adder 47 until the cumulative value exceeds the end point EP (WT). Then, since HVMODE=0 is set, a selector 50 for supplying addition data to the adder 47 selects the start address SA (WT) and outputs it to the adder 47. As a result, the cumulative value b with the start address SA (WT) added is outputted as the ADG output. Since the cumulative value b changes at the rate of the phase data as the phase data is accumulated every clock cycle, the read address as the ADG output also changes according to the phase data.

When the cumulative value b exceeds the end point EP (WT), since the MSB signal changes to "1," the selector 46 starts outputting data c outputted from the adder 45. Since HVMODE=0 is set, the data c is a calculated value with the amplitude value |a−b| added at the adder 45, where the amplitude value |a−b| is obtained by removing MSB from the subtracted value (a−b). As a result, the ADG output from the adder 47 is a read address corrected by the amplitude value |a−b| for the loop point LP (WT). Further, since the MSB signal changes to "1," the load signal is supplied to the ACC 41 so that the data c will be loaded to the ACC 41. As a result, since the MSB signal returns to "0," the data b outputted from the ACC 41 is outputted from the selector 46. Then, since the cumulative value b when the data c is added to the phase data is outputted from the ACC 41 every clock cycle, the ADG output changes at the rate corresponding to that of the phase data approximately from the read address for the loop point LP (WT).

Figure 5:
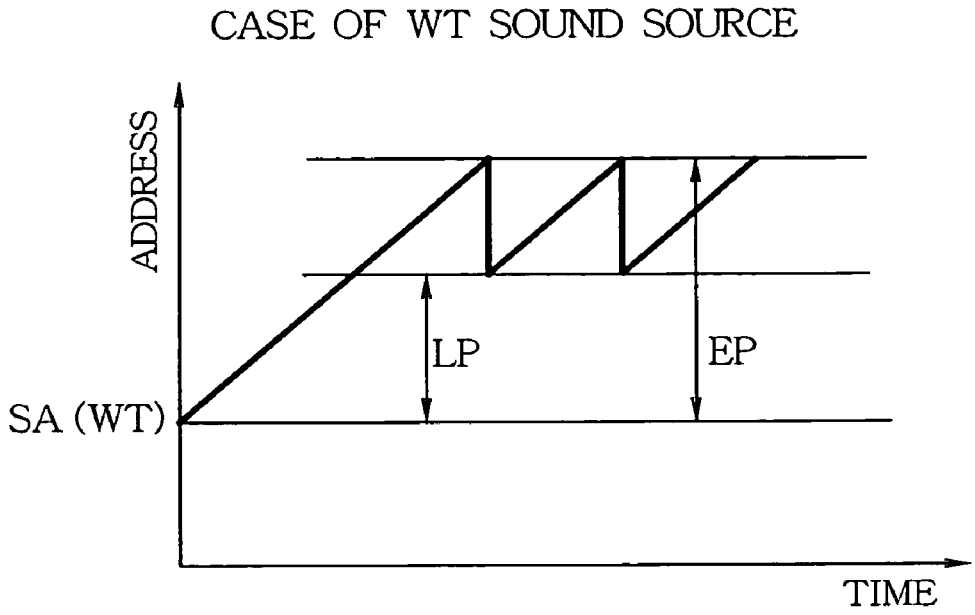
FIG. 5 is a graph showing an example of ADG output of the address generator in the voice synthesizing apparatus that also serves as the sound source apparatus according to the embodiment of the present invention.

The ADG output in this case will be described below with reference to a graph. FIG. 5 shows the ADG output. As shown, when the Key-On signal is applied, the start address SA (WT) is outputted, and the read address rises while changing at the rate corresponding to that of the phase data. Then, when the read address is incremented from the start address SA to the end point (EP), it returns to the value of the start address SA (WT) plus the loop point (LP), and from then on, the read address is continuously generated until it is incremented from the value of the start address SA (WT) plus the loop point (LP) to the end point (EP). The read address changes during this period at the rate corresponding to that of the phase data. Then, when the sound production is stopped by the Key-On signal, the ADG output is stopped. The waveform data read from the waveform data storage 22 via the read address as the ADG output takes on a frequency corresponding to that of the phase data. Since the kind of the waveform data read from the waveform data storage 22 via the read address is selectable, the start address SA (WT) may, for example, be selected for each of the WT voice parts 10*a* to 10*i* so that each of the WT voice parts 10*a* to 10*i* can produce a tone in a different timbre.

The following describes the operation of the ADG 21 serving as an address generator for the WT voice part 10*a* when it generates the voiced sound pitch signal in the condition that HVMODE=1 and U/V=0. When HVMODE=1 and U/V=0 are set, the AND gate is opened, but since no voiced sound pitch signal is supplied to the WT voice part 10*a*, only the Key-On signal is outputted from the OR gate. Therefore, the ACC 41 is reset to the initial value by the Key-On signal to start the accumulation of the phase data supplied from the PG 20 according to the voiced sound pitch signal to be generated. The accumulation is made every clock cycle, and the cumulative value b is outputted to the selector 46 and the subtracter 43. Since HVMODE=1 is set, the selector 42 for supplying data a to the subtracter 43 selects a predetermined constant value as the data a and outputs it to the subtracter 43. As a result, a subtracted value (a−b) calculated at the subtracter 43 is outputted, and an amplitude value |a−b| obtained by removing MSB from the subtracted value (a−b) is supplied to the adder 45.

Further, the MSB signal of the subtracted value (a−b) is supplied to the selector 46 as the select signal and to the ACC 41 as the load signal. If the subtracted value (a−b) is negative, that is, when the cumulative value has reached the constant value, the MSB signal becomes "1." The MSB signal as "1" is supplied to the ACC 41 as the load signal and data c is loaded to the ACC 41. Since HVMODE=1 is set, the data c is a value calculated at the adder 45 by adding the amplitude value |a−b|, obtained by removing MSB from the subtracted value (a−b), to "0" selected by the selector 44. Then, when the ACC 41 adds the phase data to the data c in the next clock cycle, the MSB signal becomes "0." Thus the MSB signal is generated in a cycle corresponding to that of the phase data based on the voiced sound pitch parameter supplied from the PG 20, that is, once in every cycle of the voiced sound pitch. The WT voice part 10*a* to which HVMODE=1 and U/V=0 are supplied outputs the MSB signal as the voiced sound pitch signal. As shown in a graph of FIG. 7, the voiced sound pitch signal is a pulse signal having a voiced sound pitch period period. In this case, the WT voice part 10*a* outputs the ADG output, but the ADG output is not used as the read address.

Figure 7:
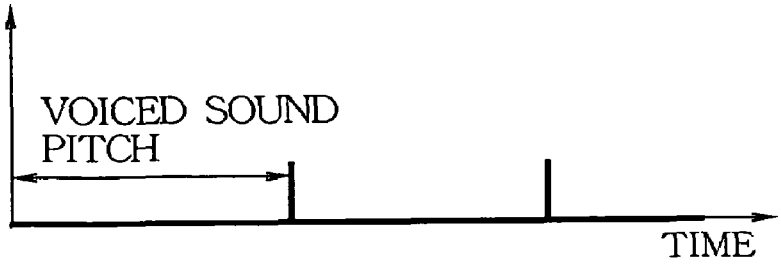
FIG. 7 is a graph showing the waveform of a voiced sound pitch signal from the address generator in the voice synthesizing apparatus that also serves as the sound source apparatus according to the embodiment of the present invention.

The following describes the operation of the ADG 21 when HVMODE=1 and U/V=0 are set for the production of voiced sound formants. When HVMODE=1 and U/V=0 are set, since the AND gate is opened by the action of a gate NOT, the ACC 41 is reset to the initial value by the voiced sound pitch signal and the Key-On signal outputted from the OR gate to start the accumulation of the phase data supplied from the PG 20 according to the center frequency of voiced sound formants to be produced. Since the voiced sound pitch signal outputted from the WT voice part 10a as shown in FIG. 7 is being supplied at the AND gate, the ACC 41 makes the accumulation every clock cycle, and outputs the cumulative value b to the selector 46 and the subtracter 43. Since HVMODE=1 is set, the selector 42 for supplying data a to the subtracter 43 selects the predetermined constant value as the data a and outputs it to the subtracter 43. The data a is set as the constant value because the amount of waveform data for forming formants is fixed. Then the subtracted value (a−b) calculated at the subtracter 43 is outputted and the amplitude value |a−b| obtained by removing MSB from the subtracted value (a−b) is supplied to the adder 45.

Further, the MSB signal of the subtracted value (a−b) is supplied to the selector 46 as the select signal and to the ACC 41 as the load signal. When the subtracted value (a−b) is negative, since the MSB signal becomes "1," the selector 46 outputs the cumulative value b to the adder 47 until the cumulative value b exceeds the constant value. Then, since HVMODE=1 is set, the selector 50 for supplying addition data to the adder 47 selects the output of the selector 49 and outputs it to the adder 47. Further, since U/V=0 is set, a start address SA (WS) for the selected waveform data for forming voiced sound formants outputted from a start address generator 48 is outputted to the selector 49. The start address generator 48 is designed to output the start address SA on the waveform data storage 22 so that waveform data will be selected according to a waveform select (WS) signal inputted to select a waveform suitable for forming the voiced sound formants. As a result, the adder 47 adds the cumulative value b to the start address SA (WS), and outputs it as the ADG output. The cumulative value b is obtained by accumulating the phase data every clock cycle, and it changes at the rate corresponding to that of the phase data. Therefore, the read address for reading the waveform data as the ADG output for forming the voiced sound formants also changes at the rate corresponding to that of the phase data.

Then, when the accumulation proceeds to reach the constant value, the subtracted value (a−b) and the MSB signal become negative and "1" respectively, and are supplied to the selector 46. As a result, the selector 46 outputs the data c. Since the HVMODE=1 is set, the data c is a value calculated at the adder 45 by adding the amplitude value |a−b|, obtained by removing MSB from the subtracted value (a−b), to "0" selected by the selector 44. Therefore, the ADG output from the adder 45 becomes the read address of the amplitude value |a−b|. Further, the MSB signal is supplied to the ACC 41 as the load signal and the data c is loaded to the ACC 41. Then, when the phase data is added to the data c in the next clock cycle, since the MSB signal returns to "0," the selector 46 outputs the data b outputted from the ACC 41. Since the ACC 41 performs accumulation of phase data every clock cycle, the ADG output in each clock cycle changes from the start address SA (WS) at the rate corresponding to that of the phase data. Then, when the ADG output is incremented by the constant value, it returns to the start address SA (WS). Thus the ADG output repeats the read address changing from the start address SA (WS) until it is incremented by the constant value. Since the phase data in this case is based on the center frequency of the voiced sound formants, the read address changes at the rate corresponding to the center frequency of the voiced sound formants. Further, since the ACC 41 is reset to the initial value by the voiced sound pitch signal outputted from the WT voice part 10*a*, the ADG output is reset every cycle of the voiced sound pitch, thereby giving a sense of pitch to the voiced sound formants having a predetermined center frequency formed from the waveform data read from the waveform data storage 22 using the ADG signal as the read address.

Figure 6:
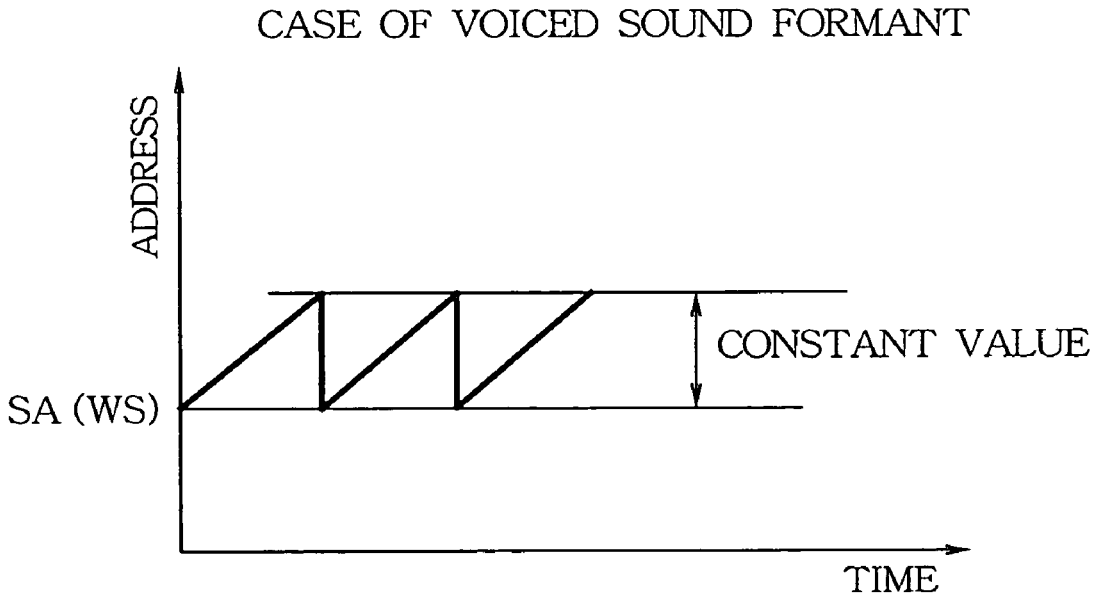
FIG. 6 is a graph showing another example of ADG output of the address generator in the voice synthesizing apparatus that also serves as the sound source apparatus according to the embodiment of the present invention.

The ADG output in this case is shown as a graph in FIG. 6. As shown, when the Key-On signal is applied, the start address SA (WS) corresponding to the WS signal to select waveform data for forming voiced sound formants is outputted. The read address rises by the action of the ACC 41 while changing at the rate corresponding to the center frequency of the voiced sound formants. Then, when the read address is incremented by the constant value from the start address SA (WS), it returns to the start address SA (WS), and from then on, the read address changing from the start address SA (WS) to the value incremented by the constant value is repeatedly generated. The selected waveform data is read by the ADG output from the waveform data storage 22 to form the voiced sound formants having the predetermined center frequency from the read waveform data. Then, when the sound production is stopped by the Key-On signal, the ADG output is stopped. Since the waveform data read from the waveform data storage 22 via the start address SA (WS), that is, by the WS (voiced sound formant) signal is selectable, the voiced sound formants formed can be changed. In FIG. 6, it is not shown that the ACC 41 is reset to the initial value by the voiced sound pitch signal outputted form the WT voice part 10*a*.

The following describes the operation of the ADG 21 when HVMODE=1 and U/V=1 are set for the production of unvoiced sound formants. When HVMODE=1 and U/V=1 are set, since the AND gate is closed by the action of the gate NOT, the ACC 41 is reset to the initial value by only the Key-On signal outputted from the OR gate to start the accumulation of the phase data supplied from the PG 20 according to the center frequency of unvoiced sound formants to be produced. The accumulation is made every clock cycle, and the cumulative value b is outputted to the selector 46 and the subtracter 43. Since HVMODE=1 is set, the selector 42 for supplying data a to the subtracter 43 selects a predetermined constant value as the data a and outputs it to the subtracter 43. The data a is set as the constant value because the amount of waveform data for forming formants is fixed. Then the subtracted value (a−b) calculated at the subtracter 43 is outputted and the amplitude value |a−b| obtained by removing MSB from the subtracted value (a−b) is supplied to the adder 45.

Further, the MSB signal of the subtracted value (a−b) is supplied to the selector 46 as the select signal and to the ACC 41 as the load signal. When the subtracted value (a−b) is negative, since the MSB signal becomes "1," the selector 46 outputs the cumulative value b to the adder 47 until the cumulative value b exceeds the constant value. Then, since HVMODE=1 is set, the selector 50 for supplying addition data to the adder 47 selects the output of the selector 49 and outputs it to the adder 47. Further, since U/V=1 is set, a start address SA (SINE) for a predetermined (fixed) sine-wave related waveform data is outputted to the selector 49. This is because the sine wave is suitable for forming unvoiced sound formants. As a result, the adder 47 adds the cumulative value b to the start address SA (SINE), and outputs it as the ADG output. The cumulative value b is obtained by accumulating the phase data every clock cycle, and it changes at the rate corresponding to the center frequency of the unvoiced sound formants. Therefore, the read address for reading the waveform data as the ADG output for forming the unvoiced sound formants also changes at the rate corresponding to the center frequency of the unvoiced sound formants.

Then, when the cumulative value b exceeds the constant value, since the MSB signal changes to "1," the selector 46 starts outputting data c outputted from the adder 45. Since HVMODE=1 is set, the data c is a value calculated at the adder 45 by adding the amplitude value |a−b|, obtained by removing MSB from the subtracted value (a−b), to "0" selected by the selector 44. As a result, the ADG output from the adder 45 is the read address of the amplitude value |a−b|. Further, the MSB signal is supplied to the ACC 41 as the load signal and the data c is loaded to the ACC 41. Then, when the phase data is added to the data c in the next clock cycle, since the MSB signal returns to "0," the selector 46 outputs the data b outputted from the ACC 41. Since the ACC 41 performs accumulation of phase data every clock cycle, the ADG output in each clock cycle changes from the start address SA (SINE) at the rate corresponding to that of the phase data. Then, when the ADG output is incremented by the constant value, it returns to the start address SA (SINE). Thus the ADG output repeats the read address changing from the start address SA (SINE) until it is incremented by the constant value. Since the phase data in this case is based on the center frequency of the unvoiced sound formants, the read address changes at the rate corresponding to the center frequency of the unvoiced sound formants. The corresponding waveform data is read from the waveform data storage 22 by the ADG signal as the read address to form the unvoiced sound formants having the predetermined center frequency.

Figure 8:
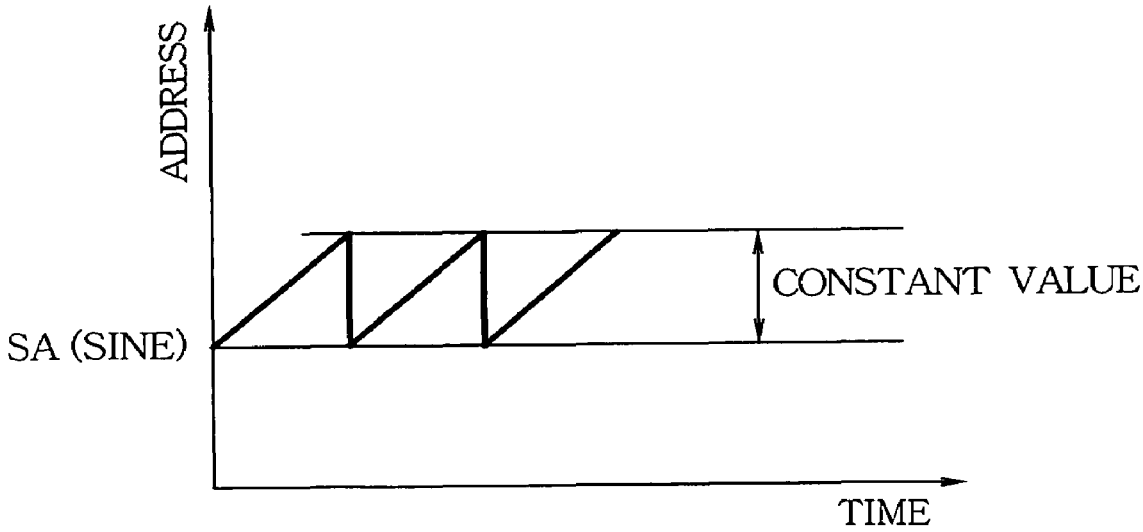
FIG. 8 is a graph showing still another example of ADG output of the address generator in the voice synthesizing apparatus that also serves as the sound source apparatus according to the embodiment of the present invention.

The ADG output in this case is shown as a graph in FIG. 8. As shown, when the Key-On signal is applied, the start address SA (SINE) for sine-wave related waveform data for forming unvoiced sound formants is outputted. The read address rises by the action of the ACC 41 while changing at the rate corresponding to the center frequency of the unvoiced sound formants. Then, when the read address is incremented by the constant value from the start address SA (SINE), it returns to the start address SA (SINE), and from then on, the read address changing from the start address SA (SINE) to the value incremented by the constant value is repeatedly generated. The selected sine-wave related waveform data is read by the ADG output from the waveform data storage 22 to form the unvoiced sound formants having the predetermined center frequency from the read waveform data. Then, when the sound production is stopped by the Key-On signal, the ADG output is stopped.

FIG. 14 shows examples of a plurality of waveform shapes for forming voiced sound formants or unvoiced sound formants stored in the waveform data storage 22.

FIG. 14 shows a case where waveform data on 32 kinds of waveform shapes are stored in the waveform data storage 22. When "0" is set as the WS (voiced sound formant) signal, a sine wave of number 0 is read out. Alternatively, for example, if "16" is set as the WS (voiced sound formant) signal, a triangular wave of number 16 will be read out. Further, the start address SA (SINE) is set as a start address for the sine wave of number 0 on the waveform data storage 22. The amount of waveform data of these 32 kinds is fixed, and the above-mentioned constant value corresponds to the data amount. Thus, when any one of the 32 kinds of waveform data is read out by the ADG output from the ADG 21, the waveform data on the selected waveform shape is repeatedly read out until the sound production is stopped.

Returning to FIG. 2, the waveform data read from the waveform data storage 22 is supplied to a multiplier 23 in which the waveform data is multiplied by an envelop signal generated by an envelop generator (EG) 24. The EG 24 is supplied with flag information on the voice mode flag (HVMODE) and the unvoiced/voiced sound indication flag (U/V), and an attack rate AR (WT), a decay rate DR (WT), a sustain rate SR (WT), a release rate RR (WT), and a sustain level SL (WT) as the tone parameters. The ADG 21 is also supplied with the Key-ON signal to instruct the start of sound production commonly used for musical sound and vocal sound.

Figure 9:
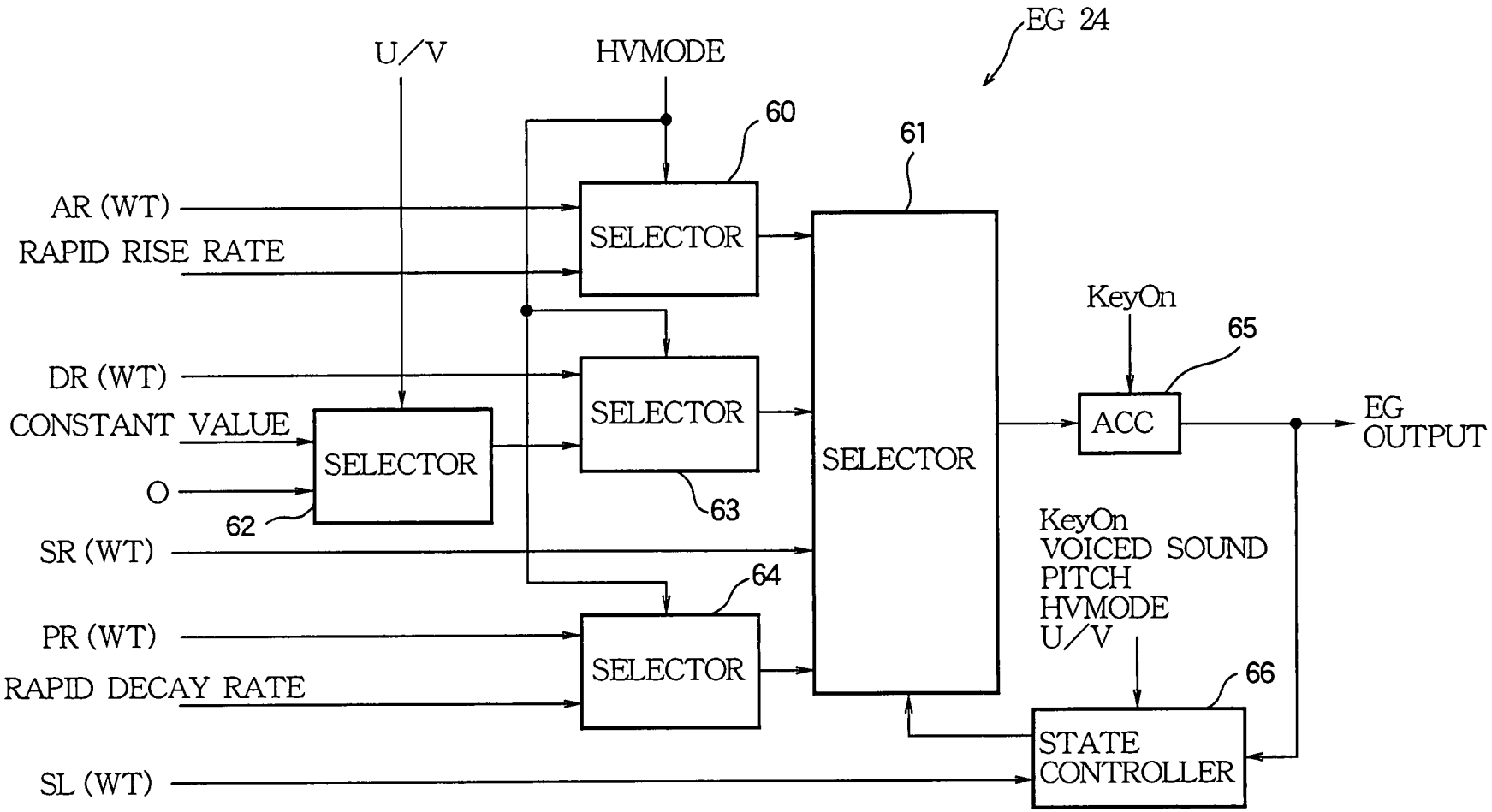
FIG. 9 is a block diagram showing the detailed structure of an envelope generator in the voice synthesizing apparatus that also serves as the sound source apparatus according to the embodiment of the present invention.

FIG. 9 is a block diagram showing the detailed structure of such an envelope generator (EG) 24.

Upon production of musical sound, as shown in FIG. 9, HVMODE=0 is set in the EG 24. In this condition, a selector 60 selects the attack rate AR (WT) and output sit to a selector 61. A selector 63 selects the decay rate DR (WT) and outputs it to the selector 61. A selector 64 selects the release rate RR (WT) and outputs it to the selector 61. The sustain rate SR (WT) is also being inputted in the selector 61. The selector 61 is controlled by a state controller 66 to select and output an envelope parameter for each state of attack, decay, sustain, and release. The state controller 66 is supplied with the sustain level SL (WT) signal as well as the Key-On signal and information on the voice mode flag (HVMODE). The state controller 66 is also supplied with the voiced sound pitch signal and flag information on the unvoiced/voiced sound indication flag (U/V), but they are not used. The envelope parameter outputted form the selector 61 on a state basis is accumulated by an accumulator (ACC) 65 to generate an envelope. The envelope is not only outputted as EG output, but also supplied to the state controller 66. The state controller 66 can judge the state from the level of the EG output. The ACC 65 starts accumulation at the start timing of the Key-On signal.

Figure 10:
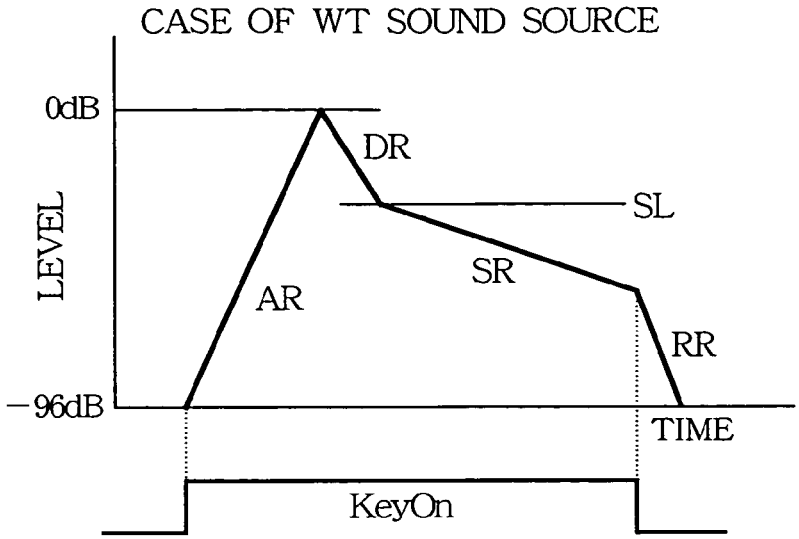
FIG. 10 is a graph showing an example of EG output of the envelope generator in the voice synthesizing apparatus that also serves as the sound source apparatus according to the embodiment of the present invention.

The EG output in this case is shown as a graph in FIG. 10. When the Key-On signal supplied to the state controller 66 and the ACC 65 is activated, the state controller 66 judges the start of sound production and instructs the selector 61 to output the attack rate AR (WT) parameter for attack as the state parameter at the start time of sound production. This attack rate AR (WT) parameter is accumulated at the ACC 65 every clock cycle, and the EG output makes a steep ascent as indicated with AR in FIG. 10. Then, when the level of the EG output reaches 0 dB for example, the state controller 66 judges that the state has shifted to decay and instructs the selector 61 to output the decay rate DR (WT) parameter. The decay rate DR (WT) parameter is accumulated at the ACC 65 every clock cycle, and the EG output makes a steep descent as shown with DR in FIG. 10.

When the EG output continues to fall and the level of the EG output reaches the sustain level SL (WT), the state controller 66 detects it and judges that the state has shifted to sustain, and instructs the selector 61 to output the sustain rate SR (WT) parameter. The output of the sustain rate SR (WT) parameter is accumulated at the ACC 65 every clock cycle, and the EG output makes a gentle descent as shown with SR in FIG. 10. The state controller 66 continues to keep the sustain state until the Key-On state is deactivated. Then, when judging that the Key-On signal is deactivated and the sound production is stopped, the state controller 66 instructs the selector 64 to output the release rate RR (WT) parameter. The output of the release rate RR (WT) parameter is accumulated at the ACC 65 every clock cycle, and the EG output makes a steep descent as shown with RR in FIG. 10 to stop the sound production.

In the case of generation of voiced sound formants upon production of voice, HVMODE=1 and U/V=0 are set in the EG 24 shown in FIG. 9. In this condition, the selector 60 selects a rapid rise rate for initial state and outputs it to the selector 61. The selector 63 selects a constant value for intermediate state selected at the selector 62 in response to the setting of U/V=0, and outputs it to the selector 61. The selector 64 selects a rapid decay rate for end state and outputs it to the selector 61. The sustain rate SR (WT) is also being inputted in the selector 61, but this parameter is not used. The selector 61 is controlled by the state controller 66 to select and output an envelope parameter for each of the initial, intermediate, and end states. The state controller 66 is supplied with the Key-ON signal, the voiced sound pitch signal outputted from the WT voice part 10*a*, and flag information on the voice mode flag (HVMODE) and the unvoiced/voiced sound indication flag (U/V). The state controller 66 is also supplied with the sustain level SL (WT) signal, but it is not used in this case. The envelope parameter outputted from the selector 61 according to the state is accumulated by the ACC 65 every clock cycle to generate an envelope. The envelope is not only outputted as the EG output, but also supplied to the state controller 66. The state controller 66 can judge the state from the level of the EG output. The ACC 65 starts accumulation at the start timing of the Key-On signal.

Figure 11:
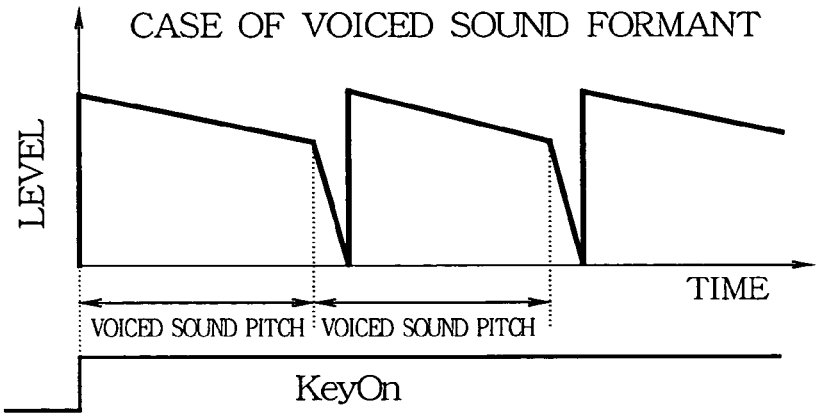
FIG. 11 is a graph showing another example of EG output of the envelope generator in the voice synthesizing apparatus that also serves as the sound source apparatus according to the embodiment of the present invention.

The EG output in this case is shown as a graph in FIG. 11. When the Key-On signal supplied to the state controller 66 and the ACC 65 is activated, the state controller 66 judges the start of sound production and instructs the selector 61 to output the rapid rise rate parameter for initial state. The rapid rise rate parameter is accumulated at the ACC 65 every clock cycle, and the EG output makes a sudden ascent as shown in FIG. 11. Then, when the level of the EG output reaches a predetermined level, the state controller 66 judges that the state has shifted to the intermediate state, and instructs the selector 61 to output the constant value parameter for intermediate state. The constant value parameter is accumulated at the ACC 65 every clock cycle, and the EG output makes a gentle descent as shown in FIG. 11.

Here, when the voiced sound pitch signal shown in FIG. 7 is inputted to the state controller 66, the state controller 66 controls the selector 61 to select and output the rapid fall rate parameter to the ACC 65. The rapid fall rate parameter is accumulated at the ACC 65 every clock cycle, and the EG output makes a steep ascent as shown in FIG. 11. Then, when the level of the EG output reaches the predetermined lowest level, the state controller 66 controls the selector 61 to select the rapid rise rate again and output it to the ACC 65. The rapid rise rate parameter is accumulated at the ACC 65 every clock cycle, and the EG output makes a sudden ascent. Then, when the level of the EG output reaches the predetermined level, the state controller 66 judges that the state has shifted to the intermediate state and instructs the selector 61 to output the constant value parameter for intermediate state. The sequence of operations is repeated from then on. Thus, since the envelope has the cycle of the voiced sound pitch, the waveform data multiplied by the envelope at the multiplier 23 can be given a sense of pitch.

Further, when judging that the Key-On signal is deactivated and the sound production is stopped, the state controller 66 controls the selector 61 to select the rapid fall rate parameter and output it to the ACC 65. The rapid fall rate parameter is accumulated at the ACC 65 every clock cycle, and the EG output makes a steep descent to stop the sound production.

In the case of generation of unvoiced sound formants upon production of voice, HVMODE=1 and U/V=1 are set in the EG 24 shown in FIG. 9. In this condition, the selector 60 selects the rapid rise rate for initial state and outputs it to the selector 61. The selector 63 selects "0" for intermediate state selected at the selector 62 in response to the setting of U/V=1, and outputs it to the selector 61. The selector 64 selects the rapid decay rate for end state and outputs it to the selector 61. The sustain rate SR (WT) is also being inputted in the selector 61, but this parameter is not used. The selector 61 is controlled by the state controller 66 to select and output an envelope parameter for each of the initial, intermediate, and end states. The state controller 66 is supplied with the Key-ON signal, and flag information on the voice mode flag (HVMODE) and the unvoiced/voiced sound indication flag (U/V). The state controller 66 is also supplied with the voiced sound pitch signal outputted from the WT voice part 10*a* and the sustain level SL (WT) signal, but they are not used in this case. The envelope parameter outputted from the selector 61 according to the state is accumulated by the ACC 65 every clock cycle to generate an envelope. The envelope is not only outputted as the EG output, but also supplied to the state controller 66. The state controller 66 can judge the state from the level of the EG output. The ACC 65 starts accumulation at the start timing of the Key-On signal.

Figure 12:
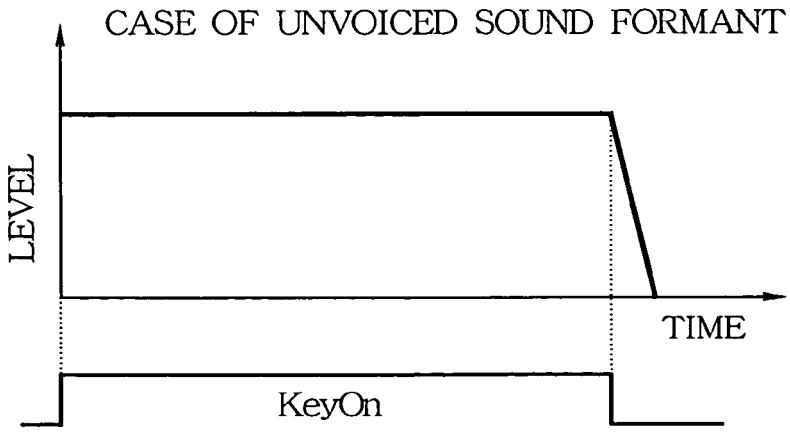
FIG. 12 is a graph showing still another example of EG output of the envelope generator in the voice synthesizing apparatus that also serves as the sound source apparatus according to the embodiment of the present invention.

The EG output in this case is shown as a graph in FIG. 12. When the Key-On signal supplied to the state controller 66 and the ACC 65 is activated, the state controller 66 judges the start of sound production and instructs the selector 61 to output the rapid rise rate parameter for initial state. The rapid rise rate parameter is accumulated at the ACC 65 every clock cycle, and the EG output makes a sudden ascent as shown in FIG. 12. Then, when the level of the EG output reaches a predetermined level, the state controller 66 judges that the state has shifted to the intermediate state, and instructs the selector 61 to output the "0" parameter for intermediate state. As a result, the EG output from the ACC 65 maintains the value as shown in FIG. 12. Here, when the Key-On signal is deactivated and the state controller 66 judges the stop of the sound production, the state controller 66 controls the selector 61 to select the rapid fall rate parameter and output it to the ACC 65. The rapid fall rate parameter is accumulated at the ACC 65, and the EG output makes a steep descent as shown in FIG. 12 to stop the sound production.

Although the EG output shown in FIGS. 10 through 12 forms an envelope moving linearly, a curved envelope may be generated. Further, the multiplier 23 for multiplying the waveform data by the output of the EG 24 may be placed downstream of an adder 25 to be described later.

Returning to FIG. 2, the waveform data multiplied by the envelope at the multiplier 23 is supplied to the adder 25 in which noise generated by a noise generator 26 is added to the waveform data. The noise is white noise for example. In this case, the noise generator 26 is supplied with flag information on the voice mode flag (HVMODE) and the unvoiced/voiced sound indication flag (U/V) so that noise is generated only when HVMODE=1 and U/V=1 are set for the generation of unvoiced sound formants. Therefore, the adder 25 adds the noise to only the waveform data multiplied by the envelope for forming unvoiced sound formants, and outputs the waveform data with the noise.

Figure 13:
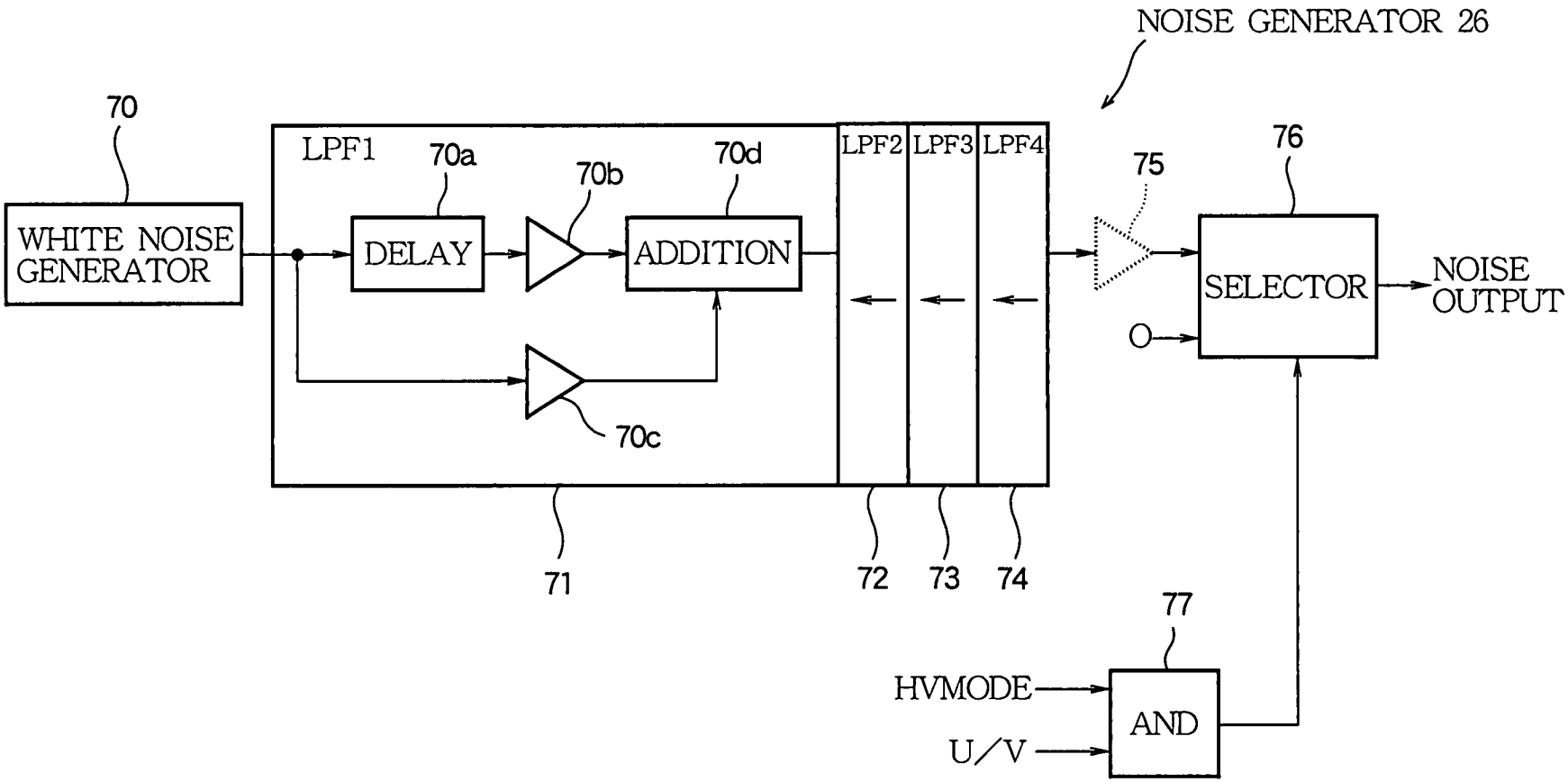
FIG. 13 is a block diagram showing the detailed structure of a noise generator in the voice synthesizing apparatus that also serves as the sound source apparatus according to the embodiment of the present invention.

FIG. 13 shows the detailed structure of the noise generator 26. As shown in FIG. 13, the white noise generated from a white noise generator 70 in the noise generator 26 is band-limited through four-stage low-pass filters (LPF 1, LPF 2, LPF 3, and LPF 4) 71, 72, 73, and 74. Then a multiplier 75 adjusts the noise level of the output of the low-pass filter 74, and inputs it to a selector 76. The selector 76 makes a selection according to the output of an AND gate 77 which outputs noise outputted from the multiplier 75 to the selector 76 when HVMODE=1 and U/V=1 are set for the generation of unvoiced sound formants. If either HVMODE=1 or U/V=1 is set to "0" for the generation of voiced sound formants, the selector 76 will output "0" instead of noise according to the output of the AND gate 77. As a result, the adder 25 adds noise to only the waveform data multiplied by the envelope for forming unvoiced sound formants, and outputs the waveform data with the noise.

The low-pass filters 71 to 74 have the same structure, and the structure of the low-pass filter 71 is shown in FIG. 13 as a representative of all the low-pass filters. In the low-pass filter 71, the white noise inputted from the white noise generator 70 is delayed one sample period through a delay circuit 70*a*, multiplied by a predetermined coefficient at a coefficient multiplier 70*b*, and inputted to an adder 70*d*. Further, the inputted white noise is multiplied by a predetermined coefficient at a coefficient multiplier 70*c*, inputted to the adder 70*d*, and added to the output of the coefficient multiplier 70*b*. The output of the adder 70*d* is the output of the low-pass filter. In this structure, for example, the white noise can be band-limited through the four-stage low-pass filters 71 to 74 to dampen a vocal component that grates on the ear. Further, the adjustment of the noise level at the multiplier 75 is not necessarily required and may be omitted.

Returning to FIG. 2, the waveform data outputted from the adder 25 is supplied to a multiplier 27 in which the output level of the waveform data is adjusted. The multiplier 27 is supplied with flag information on the voice mode flag (HVMODE) and the unvoiced/voiced sound indication flag (U/V), a level (WT) indicating the output level of a musical tone, a level (voiced sound formant) indicating the output level of voiced sound formants, and a level (unvoiced sound formant) indicating the output level of unvoiced sound formants. Then, when HVMODE=0 is set for the production of musical sound, the multiplier 27 multiplies the waveform data by the level (WT) to adjust the output level of the waveform data on the musical tone. On the other hand, when HVMODE=1 and U/V=0 are set for the generation of voiced sound formants, the multiplier 27 multiplies the waveform data by the level (voiced sound formant) to adjust the output level of the waveform data for forming the voiced sound formants so that the level of the voiced sound formants will become a predetermined level. Further, when HVMODE=1 and U/V=1 are set for the generation of unvoiced sound formants, the multiplier 27 multiplies the waveform data by the level (unvoiced sound formant) to adjust the output level of the waveform data for forming the unvoiced sound formants so that the level of the unvoiced sound formants will become a predetermined level.

In the above description of the present invention, although the voice synthesizing apparatus that also serves as the sound source apparatus is made up of the WT voice parts having the nine waveform data storage parts, the present invention is not limited to this structure. The WT voice parts may have less than nine storage parts or more than nine storage parts. If the WT voice parts have more than nine storage parts, not only the number of tones to be simultaneously sounded but also the number of formants to be synthesized can be increased, thereby synthesizing various kinds of voice.

Further, according to the present invention, the voice synthesizing apparatus that also serves as the sound source apparatus is such that when musical sound is specified by the voice mode flag (HVMODE), the multiple WT voice parts function as tone forming parts, and when vocal sound is specified by the voice mode flag (HVMODE), the multiple WT voice parts function as formant forming parts. In addition, if the voice mode flag (HVMODE) is fixed to vocal sound, the voice synthesizing apparatus can be used as a dedicated voice synthesizing apparatus.

As described above, according to the first aspect of the present invention, the multiple tone forming parts can produce tones in the wave table sound source mode, while multiple formants formed by the multiple tone forming parts can be synthesized in the voice synthesizing mode to generate a synthesized voice. Thus, since the multiple tone forming parts can be commonly used for musical tone production and voce synthesis, the voice synthesis capabilities can be implemented in the sound source apparatus without the incorporation of a separate voice synthesizing apparatus into the sound source apparatus. Further, in the voice synthesis mode, the noise adding section adds noise to the formants, thereby synthesizing a high-quality, real voice.

As described above, according to the second aspect of the present invention, the plurality of the formant forming parts as the waveform table voice parts, each of which forms a formant having a desired formant center frequency and a desired formant level, are provided with a noise adding section, so that the plurality of formants formed at the plurality of the formant forming parts are synthesized to generate a synthesized voice. Thus, since the formants are formed by adding noise by the noise adding section in the voice synthesizing apparatus, a high-quality real voice can be synthesized. In this case, it is suitable that the noise be added to waveform data for forming unvoiced sound formants to synthesize the high-quality real voice.

As described above, according to the third aspect of the present invention, the multiple formant forming parts as the waveform table voice parts form desired voiced or unvoiced sound formants so that the multiple voiced or unvoiced sound formants formed will be mixed to synthesize a voiced or unvoiced sound. Then the envelope signal of the pitch cycle is added to the waveform data for forming voiced sound formants. As a result, the voiced sound formants can be given a sense of pitch, thereby synthesizing a high-quality, real voice. Further, noise is added to the waveform data for forming unvoiced sound formants, thereby synthesizing a high-quality, real voice.

As described above, according to the fourth aspect of the present invention, each of the multiple formant forming parts as the waveform table voice parts forms a formant having a desired formant center frequency and a desired formant level so that the multiple formants formed will be synthesized to generate a synthesized voice. Then, the envelope signal of the pitch cycle is added to the waveform data for forming the formants, so that the formants can be given a sense of pitch, thereby synthesizing a high-quality, real voice. Further, since the envelope signal of the pitch cycle is added to the waveform data for forming voiced sound formants, the voiced sound formants can be given a sense of pitch.

Further, according to the invention, waveform data outputted from the multiple waveform table voice parts based on the tone parameters can be mixed to produce a plurality of tones, while waveform data for forming voiced sound formants or unvoiced sound formants outputted from the multiple waveform table voice parts based on the voice parameters can be synthesized to generate a synthesized voice. It allows the multiple wave form table voice parts to be commonly used for musical sound production and vocal sound production, and hence the voice synthesizing apparatus of the present invention to serve also as the sound source apparatus.

What is claimed is:

1. A sound source apparatus having a voice synthesis capability, comprising a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode, wherein each of the tone forming parts comprises:

a waveform shape specifying section that specifies a desired waveform shape from among a plurality of waveform shapes;

a waveform data storage section that stores waveform data corresponding to the plurality of the waveform shapes;

a waveform data reading section that operates in the wave table sound source mode for generating a variable address changing at a rate corresponding to a musical interval of the tone to be generated, and reading the waveform data corresponding to the waveform shape specified by the waveform shape specifying section from the waveform data storage section by the variable address, and that operates in the voice synthesizing mode for generating a variable address changing at a rate corresponding to a center frequency of the formant to be generated, and reading the waveform data corresponding to the waveform shape specified by the waveform shape specifying section from the waveform data storage section by the variable address; and an envelope application section that operates in the wave table sound source mode for generating an envelope signal which rises in synchronization with an instruction to start the generating of the tone and decays in synchronization with another instruction to stop the generating of the tone, and applying the generated envelope signal to the waveform data read by the waveform data reading section from the waveform data storage section, and that operates in the voice synthesizing mode for generating an envelop signal which rapidly decays every timing corresponding to a pitch period of the voice to be synthesized and rapidly rises after the decay, and applying the generated envelope signal to the waveform data read by the waveform data reading section from the waveform data storage section.

2. A sound source apparatus having a voice synthesis capability, comprising a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode, wherein each of the tone forming parts comprises:

a waveform shape specifying section that specifies a desired waveform shape from among a plurality of waveform shapes;

a waveform data storage section that stores waveform data corresponding to the plurality of the waveform shapes;

a waveform data reading section that operates in the wave table sound source mode for generating a variable address changing at a rate corresponding to a musical interval of the tone to be generated, and reading the waveform data corresponding to the waveform shape specified by the waveform shape specifying section from the waveform data storage section by the variable address, and that operates in the voice synthesizing mode for generating a variable address changing at a rate corresponding to a center frequency of the formant to be generated, and reading the waveform data corresponding to the waveform shape specified by the waveform shape specifying section from the waveform data storage section by the variable address;

an envelope application section that generates an envelope signal which rises in synchronization with an instruction to start the generating of the tone or the synthesis of the voice and decays in synchronization with another instruction to stop the generating of the tone or the synthesis of the voice, and that applies the generated envelope signal to the waveform data read by the waveform data reading section from the waveform data storage section; and a noise adding section that operates in the voice synthesizing mode for adding a noise to the waveform data with the envelope signal applied by the envelope application section.

3. A voice synthesizing apparatus comprising:

a plurality of formant forming parts, each of which forms a formant having a desired formant center frequency and a desired formant level; and a synthesizing part that mixes a plurality of the formants formed by the plurality of the formant forming parts for generating a voice, wherein each of the plurality of the formant forming parts comprises:

a waveform data storage section that stores waveform data corresponding to a predetermined waveform shape;

a waveform data reading section that generates an address changing at a rate corresponding to the formant center frequency so as to read the waveform data stored in the waveform data storage section by the generated address to thereby form the formant; and a noise adding section that adds a noise to the waveform data read by the waveform data reading section from the waveform data storage section.

4. The voice synthesizing apparatus according to claim 3, wherein the formant forming part further comprises an envelope application section that generates an envelope signal which rises in synchronization with an instruction to start the generating of the voice and decays in synchronization with another instruction to stop the generating of the voice, and that applies the envelope signal to either of the waveform data read by the waveform data reading section from the waveform data storage section or the waveform data with the noise added by the noise adding section.

5. The voice synthesizing apparatus according to claim 3, wherein the waveform data storage section stores sine waveform data.

6. The voice synthesizing apparatus according to claim 3, wherein the noise adding section comprises a noise generator for generating a white noise and a filter for limiting a spectrum band of the white noise.

7. The voice synthesizing apparatus according to claim 3, wherein the formant forming part further comprises a multiplication section that multiplies the waveform data by level data corresponding to the formant level.

8. The voice synthesizing apparatus according to claim 7, wherein the synthesizing part mixes the plurality of the formants, each of which has the desired formant center frequency and the desired formant level and is outputted from each of the plurality of the formant forming parts so as to generate the voice of an unvoiced sound.

9. A voice synthesizing apparatus comprising:

a plurality of formant forming parts for forming formants having desired formant center frequencies in the form of either voiced sound formants or unvoiced sound formants according to designation of a voiced sound synthesizing mode or an unvoiced sound synthesizing mode; and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound, wherein each of the plurality of the formant forming parts comprises:

a waveform data storage section that stores waveform data corresponding to a predetermined waveform shape;

a waveform data reading section that generates an address changing at a rate corresponding to the formant center frequency of the formant and reads the waveform data stored in the waveform data storage section in response to the generated address; and an envelope application section that operates in the voiced sound synthesizing mode for generating an envelop signal which rapidly decays every timing corresponding to a pitch period of the voiced sound and rapidly rises after the decay, and applying the generated envelope signal to the waveform data read by the waveform data reading section from the waveform data storage section, and that operates in the unvoiced sound synthesizing mode for generating an envelope signal which rises in synchronization with an instruction to start the generating of the unvoiced sound and decays in synchronization with an instruction to stop the generating of the unvoiced sound, and applying the generated envelope signal to the waveform data read by the waveform data reading section from the waveform data storage section.

10. The voice synthesizing apparatus according to claim 9, wherein each of the formant forming parts further comprises a noise adding section that operates in the unvoiced sound synthesizing mode for adding a noise to the waveform data read by the waveform data reading section from the waveform data storage section.

11. A voice synthesizing apparatus comprising:

a plurality of formant forming parts for forming formants having formant center frequencies in the form of either voiced sound formants or unvoiced sound formants according to designation of either a voiced sound synthesizing mode or an unvoiced sound synthesizing mode; and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound, wherein each of the plurality of the formant forming parts comprises:

a waveform data storage section that stores waveform data corresponding to a plurality of waveform shapes;

a waveform shape specifying section that operates in the voiced sound synthesizing mode for specifying a desired waveform shape from among the plurality of the waveform shapes, and that operates in the unvoiced sound synthesizing mode for specifying a predetermined waveform shape;

a waveform data reading section that generates an address changing at a rate corresponding to the formant center frequency and reads from the waveform data storage section the waveform data corresponding to the waveform shape specified by the waveform shape specifying section in response to the generated address; and an envelope application section that operates in the voiced sound synthesizing mode for generating an envelop signal which rapidly decays every timing corresponding to a pitch period of the voiced sound and rapidly rises after the decay, and applying the generated envelope signal to the waveform data read by the waveform data reading section from the waveform data storage section, and that operates in the unvoiced sound synthesizing mode for generating an envelope signal which rises in synchronization with an instruction to start the generating of the unvoiced sound and decays in synchronization with an instruction to stop the generating of the unvoiced sound, and applying the generated envelope signal to the waveform data read by the waveform data reading section from the waveform data storage section.

12. The voice synthesizing apparatus according to claim 11, wherein each of the formant forming parts further comprises a noise adding section that operates in the unvoiced sound synthesizing mode for adding a noise to the waveform data read by the waveform data reading section from the waveform data storage section.

13. A voice synthesizing apparatus comprising:

a plurality of formant forming parts, each of which forms a formant having a desired formant center frequency; and a synthesizing part that mixes a plurality of the formants formed by the plurality of the formant forming parts to generate a voice, wherein each of the plurality of the formant forming parts comprises:

a waveform shape specifying section that specifies a desired waveform shape from among a plurality of waveform shapes;

a waveform data storage section that stores waveform data corresponding to the plurality of the waveform shapes;

a waveform data reading section that generates an address changing at a rate corresponding to the formant center frequency and reads from the waveform data storage section the waveform data corresponding to the specified waveform shape in response to the generated address; and an envelope application section that generates an envelope signal which rapidly decays every timing corresponding to a pitch period of the voice and rapidly rises after the decay, and that applies the generated envelope signal to the waveform data read by the waveform data reading section from the waveform data storage section.

14. The voice synthesizing apparatus according to claim 13, wherein the synthesizing part mixes the plurality of the formants formed by the plurality of the formant forming parts to generate the voice in the form of a voiced sound.

15. A method of controlling a sound source apparatus having a voice synthesis capability and comprising a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode, wherein the method controls each of the tone forming parts by the steps of:

specifying a desired waveform shape from among a plurality of waveform shapes;

storing waveform data corresponding to the plurality of the waveform shapes in a memory;

generating in the wave table sound source mode a variable address changing at a rate corresponding to a musical interval of the tone to be generated, and reading the waveform data corresponding to the specified waveform shape from the memory by the variable address;

generating in the voice synthesizing mode a variable address changing at a rate corresponding to a center frequency of the formant to be generated, and reading the waveform data corresponding to the specified waveform shape from the memory by the variable address;

generating in the wave table sound source mode an envelope signal which rises in synchronization with an instruction to start the generating of the tone and decays in synchronization with another instruction to stop the generating of the tone, and applying the generated envelope signal to the read waveform data; and generating in the voice synthesizing mode an envelop signal which rapidly decays every timing corresponding to a pitch period of the voice to be synthesized and rapidly rises after the decay, and applying the generated envelope signal to the read waveform data.

16. A method of controlling a sound source apparatus having a voice synthesis capability and comprising a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode, wherein the method controls each of the tone forming parts by the steps of:

specifying a desired waveform shape from among a plurality of waveform shapes;

storing waveform data corresponding to the plurality of the waveform shapes in a memory;

generating in the wave table sound source mode a variable address changing at a rate corresponding to a musical interval of the tone to be generated, and reading the waveform data corresponding to the specified waveform shape from the memory by the variable address;

generating in the voice synthesizing mode a variable address changing at a rate corresponding to a center frequency of the formant to be generated, and reading the waveform data corresponding to the specified waveform shape from the memory by the variable address;

generating an envelope signal which rises in synchronization with an instruction to start the generating of the tone or the synthesis of the voice and decays in synchronization with another instruction to stop the generating of the tone or the synthesis of the voice, and applying the generated envelope signal to the read waveform data; and adding a noise in the voice synthesizing mode to the waveform data with the envelope signal applied.

17. A method of controlling a voice synthesizing apparatus comprising a plurality of formant forming parts, each of which forms a formant having a desired formant center frequency, and a synthesizing part that mixes a plurality of the formants formed by the plurality of the formant forming parts for generating a voice, wherein the method controls each of the plurality of the formant forming parts by the steps of:

storing waveform data corresponding to a predetermined waveform shape in a memory;

generating an address changing at a rate corresponding to the formant center frequency so as to read the waveform data stored in the memory by the generated address to thereby form the formant; and adding a noise to the waveform data read from the memory.

18. A method of controlling a voice synthesizing apparatus comprising a plurality of formant forming parts for forming formants having desired formant center frequencies in the form of either voiced sound formants or unvoiced sound formants according to designation of a voiced sound synthesizing mode or an unvoiced sound synthesizing mode, and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound, wherein the method controls each of the plurality of the formant forming parts by the steps of:

storing waveform data corresponding to a predetermined waveform shape in a memory;

generating an address changing at a rate corresponding to the formant center frequency of the formant and reading the waveform data from the memory in response to the generated address;

generating in the voiced sound synthesizing mode an envelop signal which rapidly decays every timing corresponding to a pitch period of the voiced sound and rapidly rises after the decay, and applying the generated envelope signal to the waveform data read from the memory; and generating in the unvoiced sound synthesizing mode an envelope signal which rises in synchronization with an instruction to start the generating of the unvoiced sound and decays in synchronization with an instruction to stop the generating of the unvoiced sound, and applying the generated envelope signal to the waveform data read from the memory.

19. A method of controlling a voice synthesizing apparatus comprising a plurality of formant forming parts for forming formants having formant center frequencies in the form of either voiced sound formants or unvoiced sound formants according to designation of either a voiced sound synthesizing mode or an unvoiced sound synthesizing mode, and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound, wherein the method controls each of the plurality of the formant forming parts by the steps of:

storing waveform data corresponding to a plurality of waveform shapes in a memory;

specifying a desired waveform shape from among the plurality of the waveform shapes in the voiced sound synthesizing mode;

specifying a predetermined waveform shape in the unvoiced sound synthesizing mode;

generating an address changing at a rate corresponding to the formant center frequency, and reading from the memory the waveform data corresponding to the specified waveform shape in response to the generated address;

generating in the voiced sound synthesizing mode an envelop signal which rapidly decays every timing corresponding to a pitch period of the voiced sound and rapidly rises after the decay, and applying the generated envelope signal to the waveform data read from the memory; and generating in the unvoiced sound synthesizing mode an envelope signal which rises in synchronization with an instruction to start the generating of the unvoiced sound and decays in synchronization with an instruction to stop the generating of the unvoiced sound, and applying the generated envelope signal to the waveform data read from the memory.

20. A method of controlling a voice synthesizing apparatus comprising a plurality of formant forming parts, each of which forms a formant having a desired formant center frequency, and a synthesizing part that mixes a plurality of the formants formed by the plurality of the formant forming parts to generate a voice, wherein the method controls each of the plurality of the formant forming parts by the steps of:

specifying a desired waveform shape from among a plurality of waveform shapes;

storing waveform data corresponding to the plurality of the waveform shapes in a memory;

generating an address changing at a rate corresponding to the formant center frequency, and reading from the memory the waveform data corresponding to the specified waveform shape in response to the generated address; and generating an envelope signal which rapidly decays every timing corresponding to a pitch period of the voice and rapidly rises after the decay, and applying the generated envelope signal to the waveform data read from the memory.

21. A computer-readable medium storing a computer program for use in a sound source apparatus having a voice synthesis capability and comprising a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode, the computer program being executable by the sound source apparatus for controlling each of the tone forming parts by the steps of:

specifying a desired waveform shape from among a plurality of waveform shapes;

storing waveform data corresponding to the plurality of the waveform shapes in a memory;

generating in the wave table sound source mode a variable address changing at a rate corresponding to a musical interval of the tone to be generated, and reading the waveform data corresponding to the specified waveform shape from the memory by the variable address;

generating in the voice synthesizing mode a variable address changing at a rate corresponding to a center frequency of the formant to be generated, and reading the waveform data corresponding to the specified waveform shape from the memory by the variable address;

generating in the wave table sound source mode an envelope signal which rises in synchronization with an instruction to start the generating of the tone and decays in synchronization with another instruction to stop the generating of the tone, and applying the generated envelope signal to the read waveform data; and generating in the voice synthesizing mode an envelop signal which rapidly decays every timing corresponding to a pitch period of the voice to be synthesized and rapidly rises after the decay, and applying the generated envelope signal to the read waveform data.

22. A computer-readable medium storing a computer program for use in a sound source apparatus having a voice synthesis capability and comprising a plurality of tone forming parts for outputting either of desired tones or formants according to designation of a wave table sound source mode or a voice synthesizing mode, such that the tone forming parts generate the tones in the wave table sound source mode, and generate the formants for synthesis of a voice in the voice synthesizing mode, the computer program being executable by the sound source apparatus for controlling each of the tone forming parts by the steps of:

specifying a desired waveform shape from among a plurality of waveform shapes;

storing waveform data corresponding to the plurality of the waveform shapes in a memory;

generating in the wave table sound source mode a variable address changing at a rate corresponding to a musical interval of the tone to be generated, and reading the waveform data corresponding to the specified waveform shape from the memory by the variable address;

generating in the voice synthesizing mode a variable address changing at a rate corresponding to a center frequency of the formant to be generated, and reading the waveform data corresponding to the specified waveform shape from the memory by the variable address;

generating an envelope signal which rises in synchronization with an instruction to start the generating of the tone or the synthesis of the voice and decays in synchronization with another instruction to stop the generating of the tone or the synthesis of the voice, and applying the generated envelope signal to the read waveform data; and adding a noise in the voice synthesizing mode to the waveform data with the envelope signal applied.

23. A computer-readable medium storing a computer program for use in a voice synthesizing apparatus comprising a plurality of formant forming parts, each of which forms a formant having a desired formant center frequency, and a synthesizing part that mixes a plurality of the formants formed by the plurality of the formant forming parts for generating a voice, the computer program being executable by the voice synthesizing apparatus for controlling each of the formant forming parts by the steps of:

storing waveform data corresponding to a predetermined waveform shape in a memory;

generating an address changing at a rate corresponding to the formant center frequency so as to read the waveform data stored in the memory by the generated address to thereby form the formant; and adding a noise to the waveform data read from the memory.

24. A computer-readable medium storing a computer program for use in a voice synthesizing apparatus comprising a plurality of formant forming parts for forming formants having desired formant center frequencies in the form of either voiced sound formants or unvoiced sound formants according to designation of a voiced sound synthesizing mode or an unvoiced sound synthesizing mode, and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound, the computer program being executable by the voice synthesizing apparatus for controlling each of the formant forming parts by the steps of:

generating an address changing at a rate corresponding to the formant center frequency of the formant and reading the waveform data from the memory in response to the generated address;

generating in the voiced sound synthesizing mode an envelop signal which rapidly decays every timing corresponding to a pitch period of the voiced sound and rapidly rises after the decay, and applying the generated envelope signal to the waveform data read from the memory; and generating in the unvoiced sound synthesizing mode an envelope signal which rises in synchronization with an instruction to start the generating of the unvoiced sound and decays in synchronization with an instruction to stop the generating of the unvoiced sound, and applying the generated envelope signal to the waveform data read from the memory.

25. A computer-readable medium storing a computer program for use in a voice synthesizing apparatus comprising a plurality of formant forming parts for forming formants having formant center frequencies in the form of either voiced sound formants or unvoiced sound formants according to designation of either a voiced sound synthesizing mode or an unvoiced sound synthesizing mode, and a synthesizing part that mixes a plurality of the voiced sound formants formed by the plurality of the formant forming parts to generate a voiced sound, and that mixes a plurality of the unvoiced sound formants formed by the plurality of the formant forming parts to generate an unvoiced sound, the computer program being executable by the voice synthesizing apparatus for controlling each of the formant forming parts by the steps of:

specifying a desired waveform shape from among the plurality of the waveform shapes in the voiced sound synthesizing mode;

specifying a predetermined waveform shape in the unvoiced sound synthesizing mode;

generating an address changing at a rate corresponding to the formant center frequency, and reading from the memory the waveform data corresponding to the specified waveform shape in response to the generated address;

generating in the voiced sound synthesizing mode an envelop signal which rapidly decays every timing corresponding to a pitch period of the voiced sound and rapidly rises after the decay, and applying the generated envelope signal to the waveform data read from the memory; and generating in the unvoiced sound synthesizing mode an envelope signal which rises in synchronization with an instruction to start the generating of the unvoiced sound and decays in synchronization with an instruction to stop the generating of the unvoiced sound, and applying the generated envelope signal to the waveform data read from the memory.

26. A computer-readable medium storing a computer program for use in a voice synthesizing apparatus comprising a plurality of formant forming parts, each of which forms a formant having a desired formant center frequency, and a synthesizing part that mixes a plurality of the formants formed by the plurality of the formant forming parts to generate a voice, the computer program being executable by the voice synthesizing apparatus for controlling each of the formant forming parts by the steps of:

specifying a desired waveform shape from among a plurality of waveform shapes;

storing waveform data corresponding to the plurality of the waveform shapes in a memory;

generating an address changing at a rate corresponding to the formant center frequency, and reading from the memory the waveform data corresponding to the specified waveform shape in response to the generated address; and generating an envelope signal which rapidly decays every timing corresponding to a pitch period of the voice and rapidly rises after the decay, and applying the generated envelope signal to the waveform data read from the memory.

* * * * *